US011193457B2

(12) United States Patent
Yoshioka et al.

(10) Patent No.: US 11,193,457 B2
(45) Date of Patent: Dec. 7, 2021

(54) EGR GAS DISTRIBUTOR

(71) Applicant: AISAN KOGYO KABUSHIKI KAISHA, Obu (JP)

(72) Inventors: Mamoru Yoshioka, Nagoya (JP); Akinari Yasue, Tokai (JP); Kaisho So, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/925,949

(22) Filed: Jul. 10, 2020

(65) Prior Publication Data

US 2021/0010446 A1 Jan. 14, 2021

(30) Foreign Application Priority Data

Jul. 11, 2019 (JP) ..... JP2019-129367

(51) Int. Cl.

| | |
|---|---|
| ***F02M 26/44*** | (2016.01) |
| ***F02M 35/10*** | (2006.01) |
| ***F02M 26/41*** | (2016.01) |
| ***F02M 26/17*** | (2016.01) |
| ***F02M 26/19*** | (2016.01) |

(52) U.S. Cl.

CPC ..... *F02M 26/44* (2016.02); *F02M 26/17* (2016.02); *F02M 26/19* (2016.02); *F02M 26/41* (2016.02); *F02M 35/10222* (2013.01)

(58) Field of Classification Search

CPC ..... F02M 26/44; F02M 35/10222

See application file for complete search history.

(56) References Cited

U.S. PATENT DOCUMENTS

| | | | | |
|---|---|---|---|---|
| 7,032,579 | B2 * | 4/2006 | Nishida | F02M 35/10085 123/568.17 |
| 9,057,346 | B2 * | 6/2015 | Sato | F02M 35/10111 |
| 10,082,112 | B2 * | 9/2018 | Nakamura | F02M 26/20 |
| 10,113,519 | B2 * | 10/2018 | Ito | F02M 35/10091 |
| 10,161,366 | B2 * | 12/2018 | Ito | F02M 35/10222 |

(Continued)

FOREIGN PATENT DOCUMENTS

| | | |
|---|---|---|
| JP | 2012-087732 A | 5/2012 |
| JP | 2013-019315 A | 1/2013 |

(Continued)

*Primary Examiner* — Kevin R Steckbauer

(74) *Attorney, Agent, or Firm* — Oliff PLC

(57) ABSTRACT

An EGR gas distributor includes a gas chamber, a gas inflow passage to introduce EGR gas on its upstream side, gas outflow passages to discharge the EGR gas to branch pipes on their downstream side. An inner wall on a downstream side of the gas chamber is divided into downstream-side divided walls corresponding to the respective gas outflow passages, and the downstream-side divided walls are curved or slanted to be of protrusion-like shape protruding toward the corresponding gas outflow passages. Downstream-side dividing ridges are provided each between the adjacent downstream-side divided walls. An inner wall on the upstream side of the gas chamber is placed to face the downstream-side inner wall and provided with at least one upstream-side ridge protruding toward the downstream-side divided walls in each area corresponding to the downstream-side divided walls.

7 Claims, 21 Drawing Sheets

(56) References Cited

U.S. PATENT DOCUMENTS

| | | | | |
|---|---|---|---|---|
| 10,344,720 | B2 * | 7/2019 | Ito | F02M 35/10222 |
| 10,359,007 | B2 * | 7/2019 | Ito | F02M 35/1045 |
| 10,731,607 | B2 * | 8/2020 | Sakurai | F02M 35/104 |
| 11,008,983 | B1 * | 5/2021 | Yoshioka | F02M 35/10222 |
| 2005/0039730 | A1 * | 2/2005 | Nishida | F02M 26/41 123/568.17 |
| 2014/0014056 | A1 * | 1/2014 | Sato | F02M 26/41 123/184.47 |
| 2017/0211519 | A1 * | 7/2017 | Ito | F02M 35/104 |
| 2017/0226968 | A1 * | 8/2017 | Nakamura | F02M 26/20 |
| 2018/0045150 | A1 * | 2/2018 | Ito | F02M 26/44 |
| 2018/0119655 | A1 * | 5/2018 | Ito | F02M 35/112 |
| 2018/0149120 | A1 * | 5/2018 | Ito | F02M 35/10222 |
| 2018/0347520 | A1 * | 12/2018 | Sakurai | F02M 35/112 |
| 2021/0010446 | A1 * | 1/2021 | Yoshioka | F02M 26/17 |

FOREIGN PATENT DOCUMENTS

| | | | |
|---|---|---|---|
| JP | 2013-068129 | A | 4/2013 |
| JP | 2016-089687 | A | 5/2016 |
| JP | 2017-141675 | A | 8/2017 |
| JP | 2018-091332 | A | 6/2018 |

* cited by examiner

EGR GAS DISTRIBUTOR

CROSS-REFERENCE TO RELATED APPLICATIONS

This application is based upon and claims the benefit of priority from the prior Japanese Patent Application No. 2019-129367, filed Jul. 11, 2019, the entire contents of which are incorporated herein by reference.

BACKGROUND

Technical Field

The technique disclosed in this specification relates to an EGR gas distributor provided in an intake manifold for distributing EGR gas to a plurality of cylinders of an engine.

Related Art

Heretofore, as this type of technique, a "gas distribution apparatus" (an EGR gas distributor) described in JP2017-141675A has been known, for example. This EGR gas distributor includes a volume chamber (a gas chamber) in which the EGR gas is collected, an upstream-side gas diversion passage (a gas inflow passage) placed on an upstream side of the gas chamber to introduce EGR gas into the gas chamber, and a plurality of downstream-side gas diversion passages (gas outflow passages) on a downstream side of the gas chamber to discharge the EGR gas in the gas chamber to a plurality of branch pipes of an intake manifold. Herein, an inner wall of the gas chamber on its downstream side (an inner wall to which the gas outflow passages open) is divided into a plurality of inner walls corresponding to each of the branch pipes and slanted toward openings of the respective gas outflow passages. By this configuration, condensed water generated in the gas chamber is guided to the respective gas outflow passages along the slanted divided inner walls. Thereby, the condensed water is prevented from concentratedly flowing in one specified gas outflow passage.

SUMMARY

Technical Problems

However, in the EGR gas distributor described in JP2017-141675A, an inner wall on an upstream side of the gas chamber (an inner wall to which the respective gas inflow passage opens) is only shaped to be flat, and thus the condensed water generated in that inner wall tends to lodge on corners of the inner wall by the surface tension. As a result of this, the condensed water that has lodged on the corners could concentratedly fall or flow downward to the specified gas outflow passage, and could further flow at once to a specified cylinder of an engine through a specified branch pipe.

The present disclosure has been made in view of the above circumstance, and has a purpose of providing an EGR gas distributor that can positively distribute and discharge condensed water generated in a gas chamber to a plurality of gas outflow passages and that can also distribute and discharge condensed water generated on an inner wall on an upstream side of the gas chamber to a plurality of the gas outflow passages without being concentrated in a specified portion.

Means of Solving the Problems

To achieve the above purpose, the technique according to one aspect of the present disclosure provides an EGR gas distributor configured to distribute EGR gas to each of a plurality of branch pipes configuring an intake manifold, the EGR gas distributor comprising: a gas chamber in which the EGR gas is collected; a gas inflow passage configured to introduce the EGR gas into the gas chamber on an upstream side of the gas chamber; a plurality of gas outflow passages configured to discharge the EGR gas residing in the gas chamber to a plurality of the branch pipes on a downstream side of the gas chamber; and an inner wall on the downstream side of the gas chamber being divided into a plurality of downstream-side divided walls each of which corresponds to each of a plurality of the gas outflow passages and each of which is curved or slanted to be of protrusion-like shape protruding toward an inlet of the corresponding gas outflow passage, and a downstream-side dividing ridge as a boundary provided between the adjacent downstream-side divided walls, wherein an inner wall on the upstream side of the gas chamber is placed to face the inner wall on the downstream side and is provided with at least one upstream-side protruding portion protruding toward the downstream-side divided wall in each area corresponding to the respective downstream-side divided walls.

According to the above-described technique, the condensed water generated in the gas chamber can be distributed and discharged positively to each of a plurality of the gas outflow passages, and also the condensed water generated on the inner wall on the upstream side of the gas chamber can be distributed and discharged to each of the gas outflow passages without being concentrated in a specified portion. As a result of this, the condensed water generated in the gas chamber is prevented from being lodged in the gas chamber and can be discharged little by little to the respective branch pipes of the intake manifold, and further discharged to the cylinders of the engine. This can also prevent the condensed water from concentratedly flowing at once to a specified branch pipe, further to a specified cylinder, so that misfire on the engine due to inflow of a large amount of condensed water can be prevented.

DETAILED DESCRIPTION OF THE EXEMPLARY EMBODIMENTS

First to ninth embodiments embodying an EGR gas distributor are explained with detail with reference to the accompanying drawings.

First Embodiment

A first embodiment is now explained.

(Intake Manifold Provided with EGR Gas Distributor)

Figure 1:
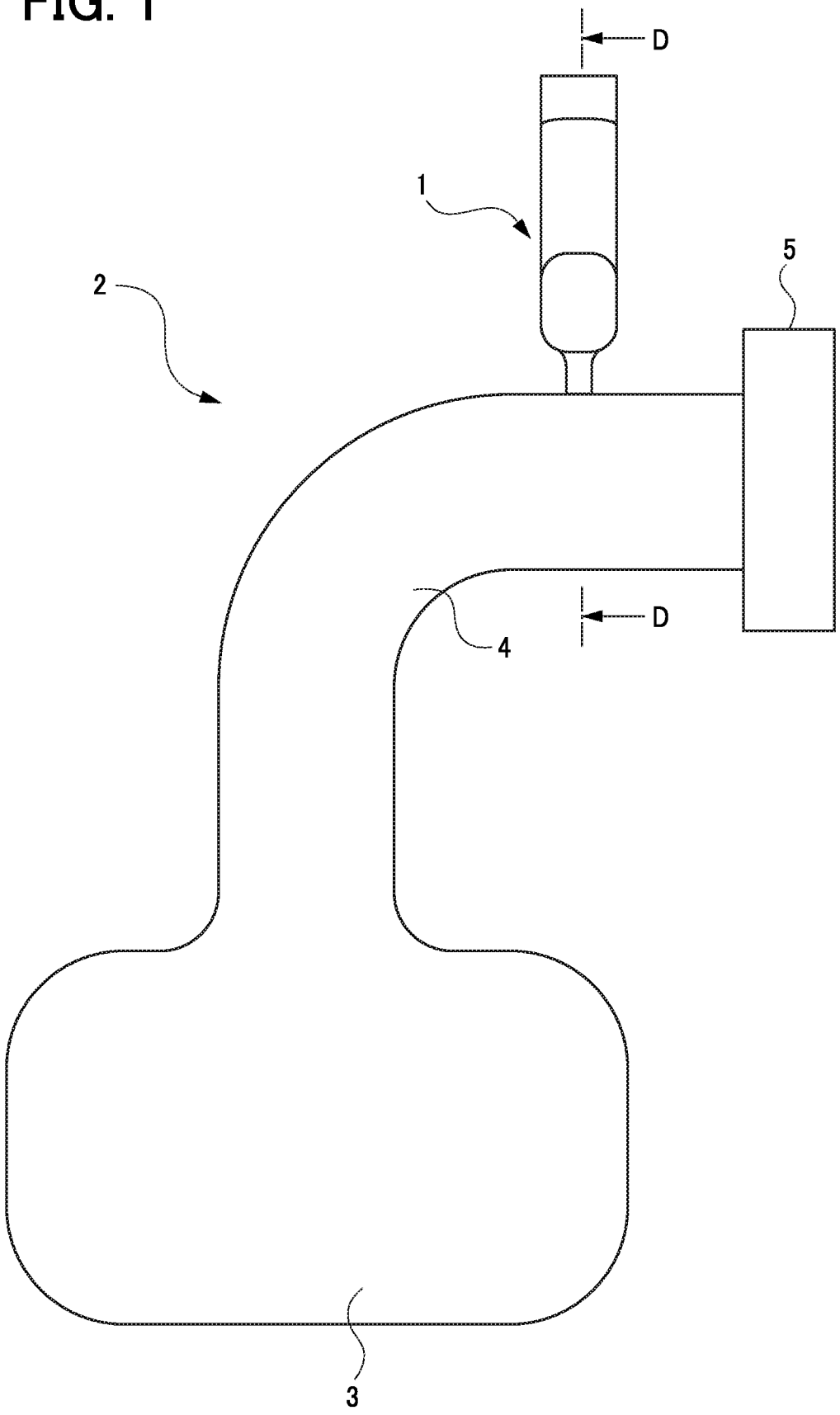
FIG. 1 is a side view of an intake manifold provided with an EGR gas distributor in a first embodiment.

FIG. 1 shows a side view of an intake manifold 2 provided with an EGR gas distributor 1 according to the present embodiment. A state illustrated in FIG. 1 indicates an arrangement state of the intake manifold 2 mounted on an engine in a vehicle, and an upper and lower direction of arrangement is as the one indicated in FIG. 1. The intake manifold 2 includes a surge tank 3, a plurality of branch pipes 4 (only one of them is illustrated in FIG. 1) branched off from the surge tank 3, and an outlet flange 5 connecting the respective branch pipes 4 to the engine. In the present embodiment, the intake manifold 2 includes the four branch pipes 4 in accordance with the engine with four cylinders. In the present embodiment, the EGR gas distributor 1 is placed on an upper side of the intake manifold 2 (the respective branch pipes 4) in a vicinity of the outlet flange 5 and formed of resin material integrally with the branch pipes 4 so that the EGR gas is distributed to each of the branch pipes 4.

(Overview of EGR Gas Distributor)

Figure 2:
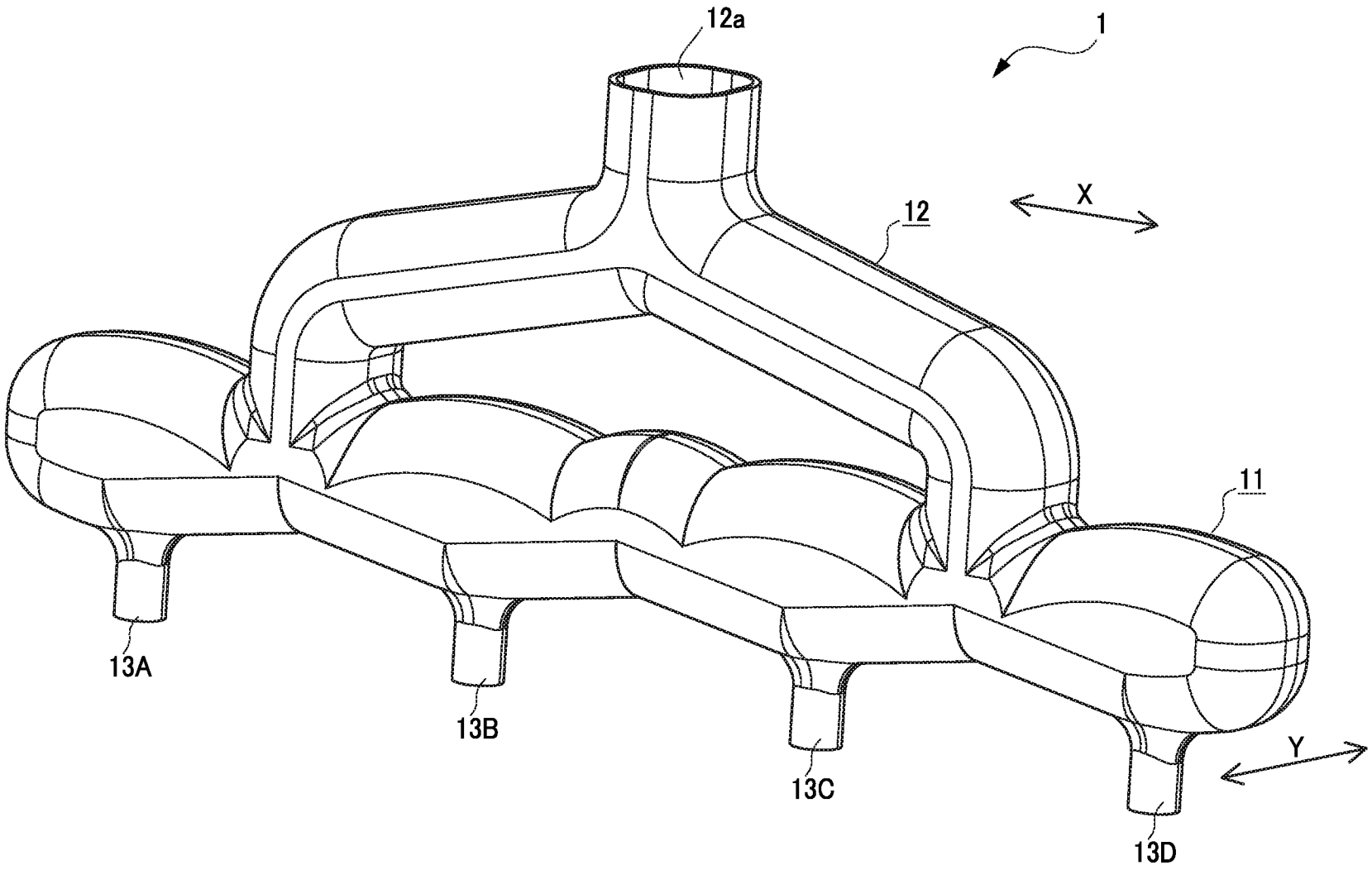
FIG. 2 is a perspective view of the EGR gas distributor in the first embodiment.
Figure 3:
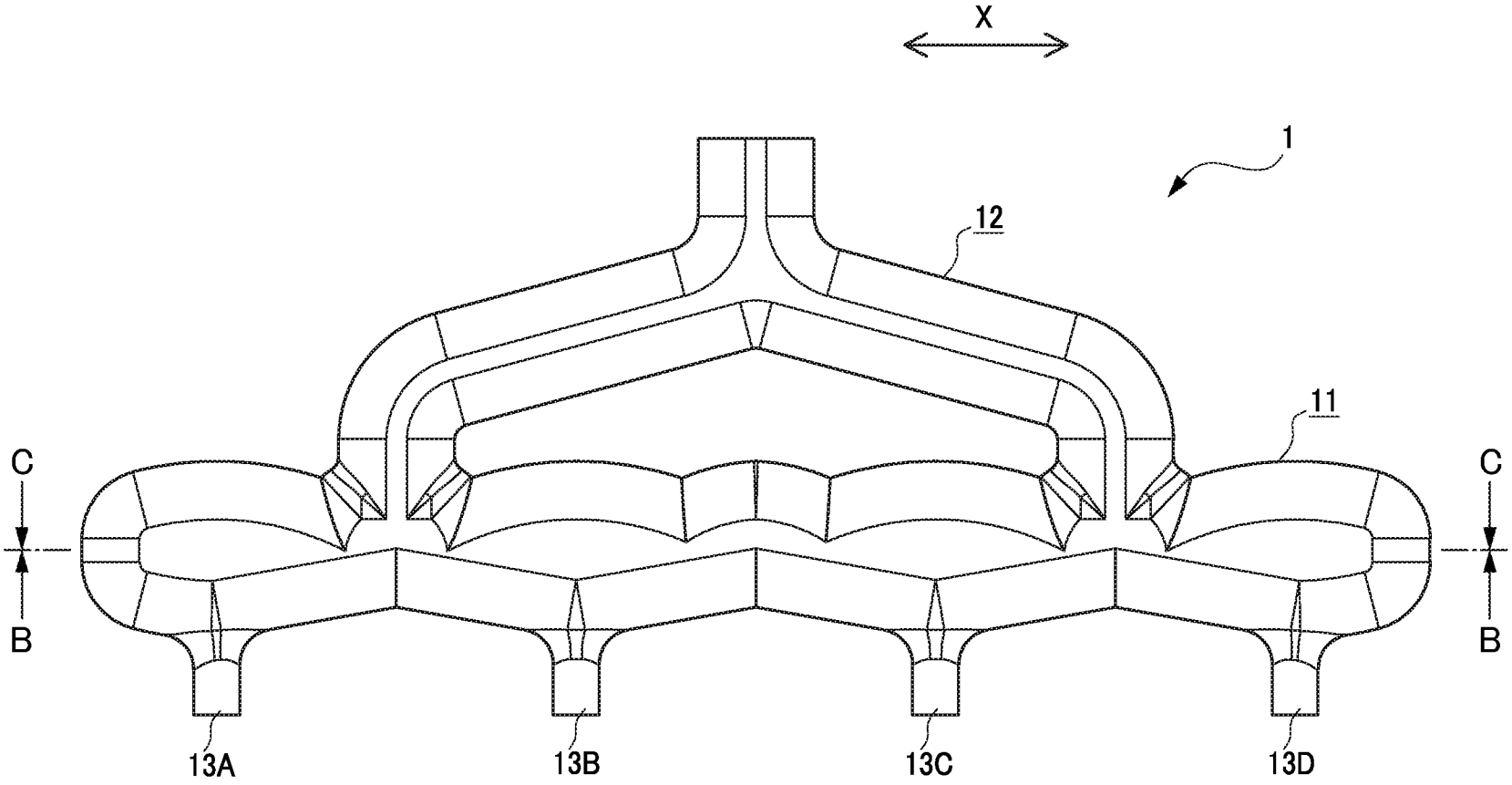
FIG. 3 is a front view of the EGR gas distributor in the first embodiment.
Figure 4:
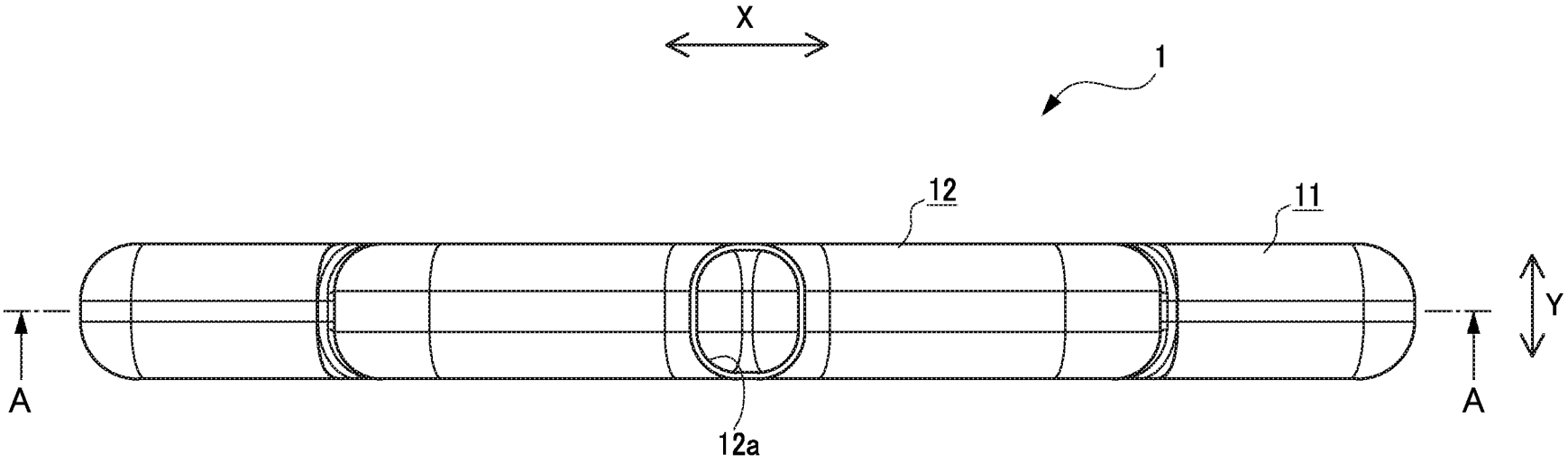
FIG. 4 is a plan view of the EGR gas distributor in the first embodiment.
Figure 5:
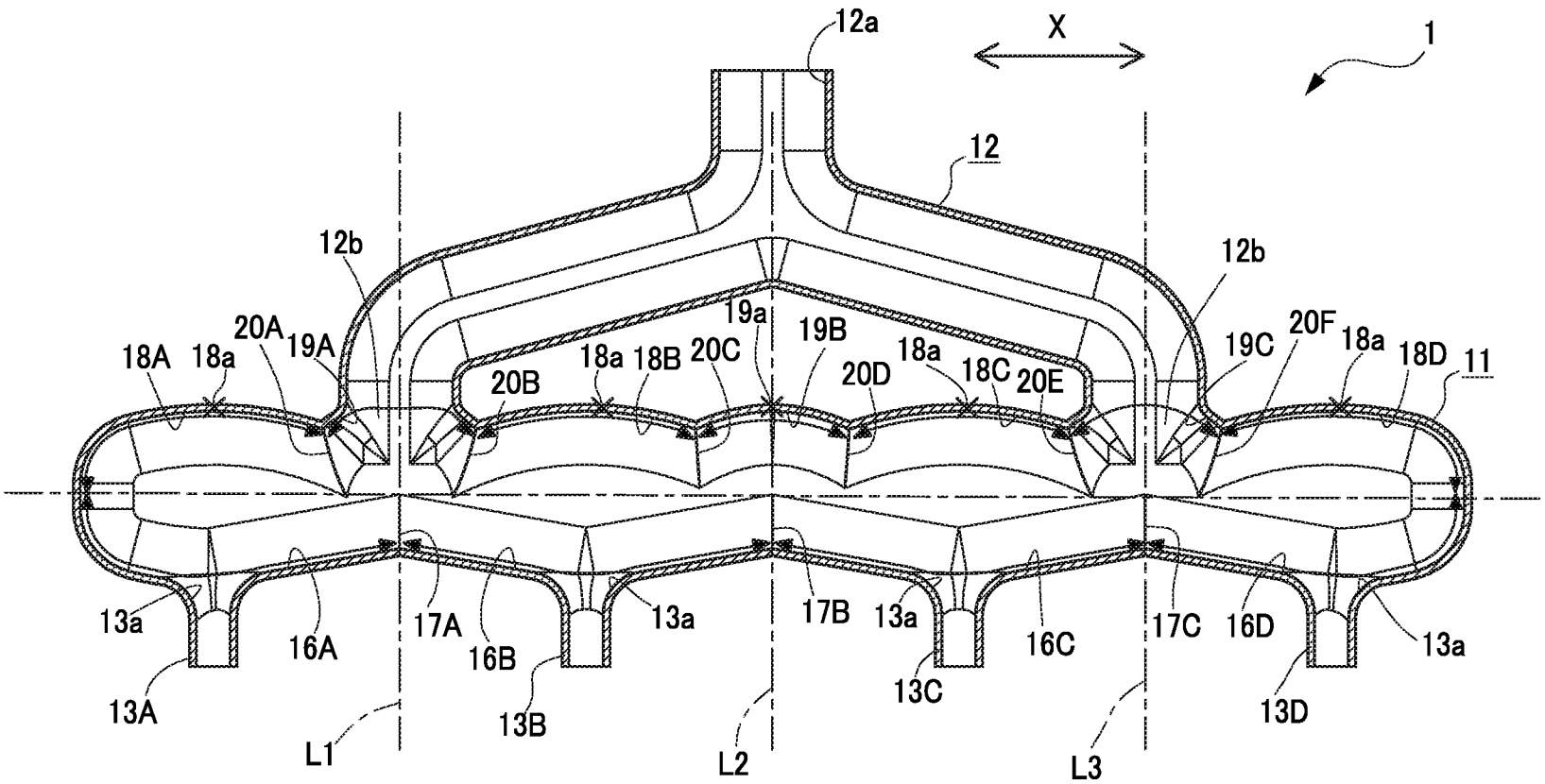
FIG. 5 is a cross-sectional view of the EGR gas distributor in the first embodiment taken along a line A-A in FIG. 4.
Figure 6:
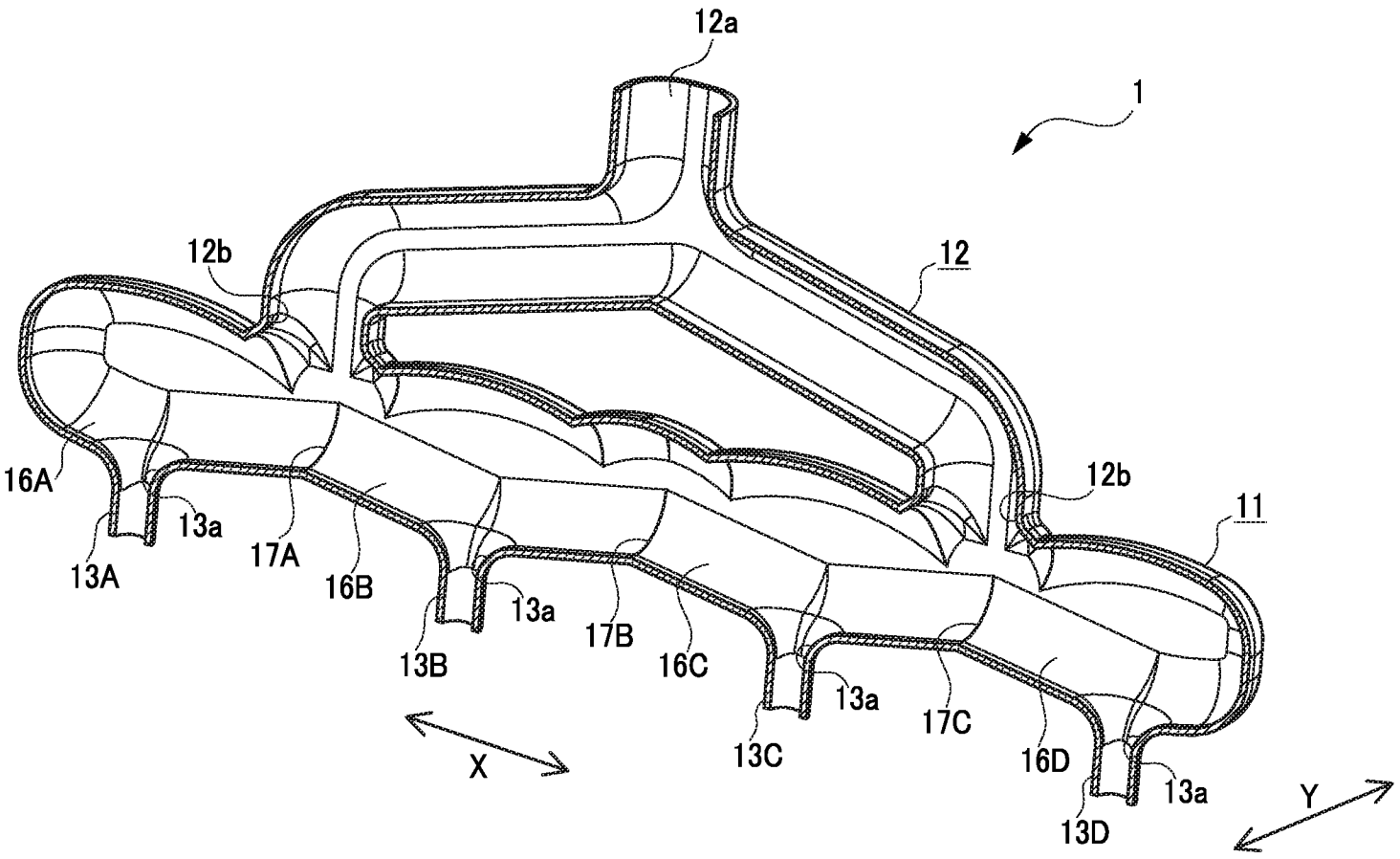
FIG. 6 is a perspective view of the cross-sectional view of the EGR gas distributor in FIG. 5 in the first embodiment.
Figure 7:
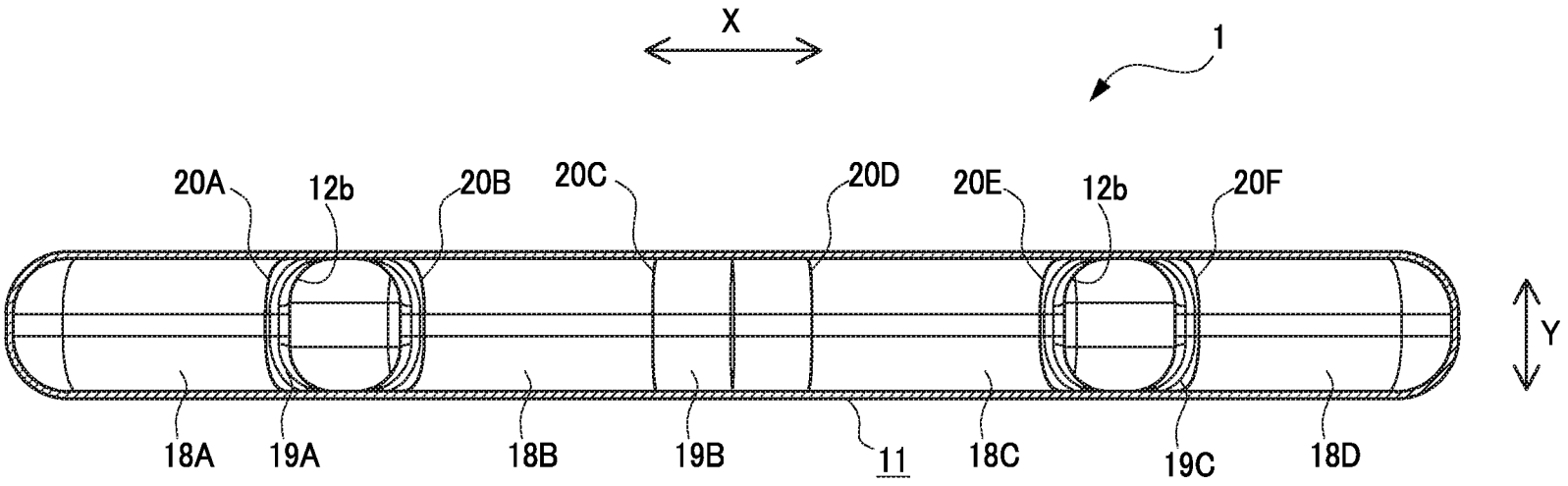
FIG. 7 is a cross-sectional view of the EGR gas distributor in the first embodiment taken along a line B-B in FIG. 3.
Figure 8:
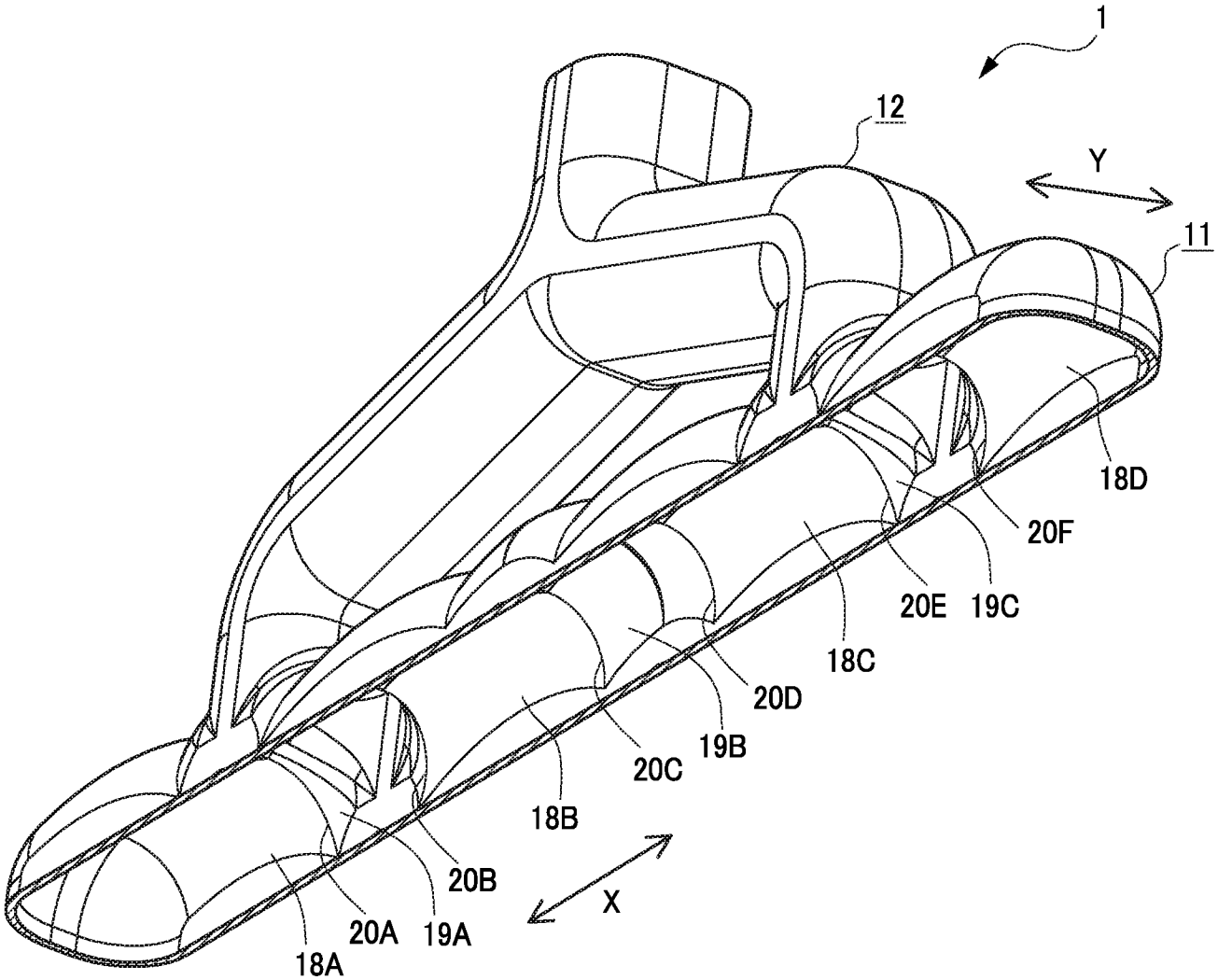
FIG. 8 is a perspective view of the cross-sectional view of the EGR gas distributor in FIG. 7 in the first embodiment.
Figure 9:
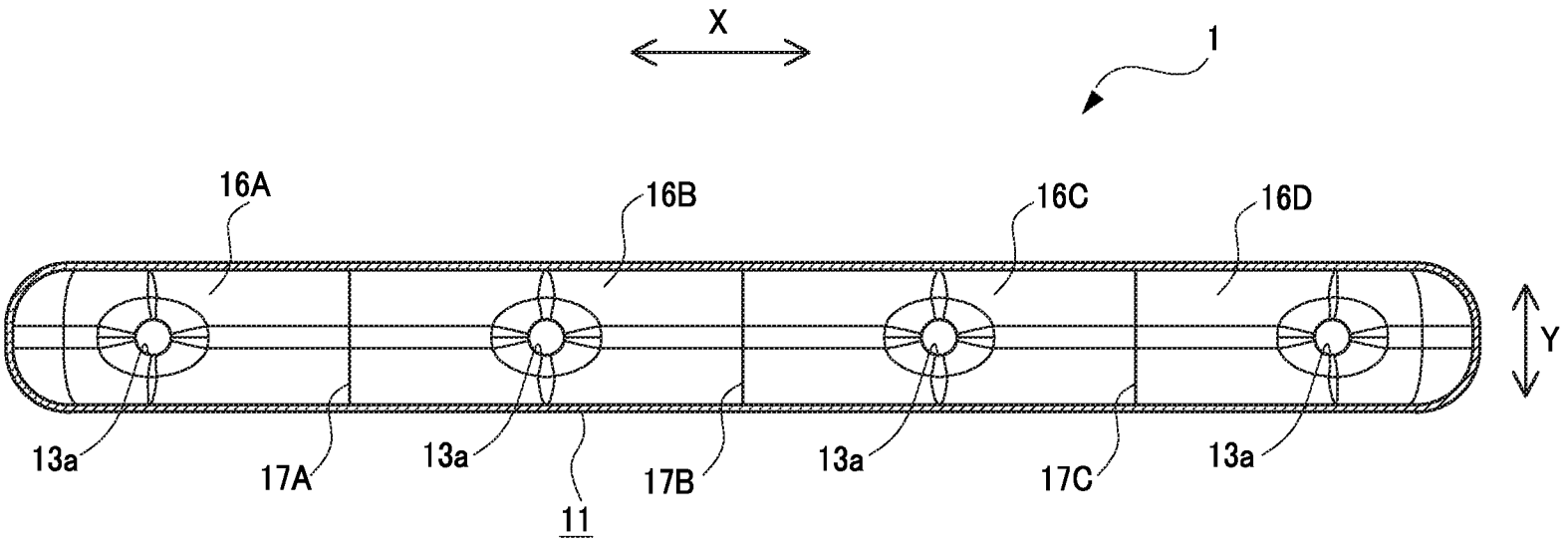
FIG. 9 is a cross-sectional view of the EGR gas distributor in the first embodiment taken along a line C-C in FIG. 3.
Figure 10:
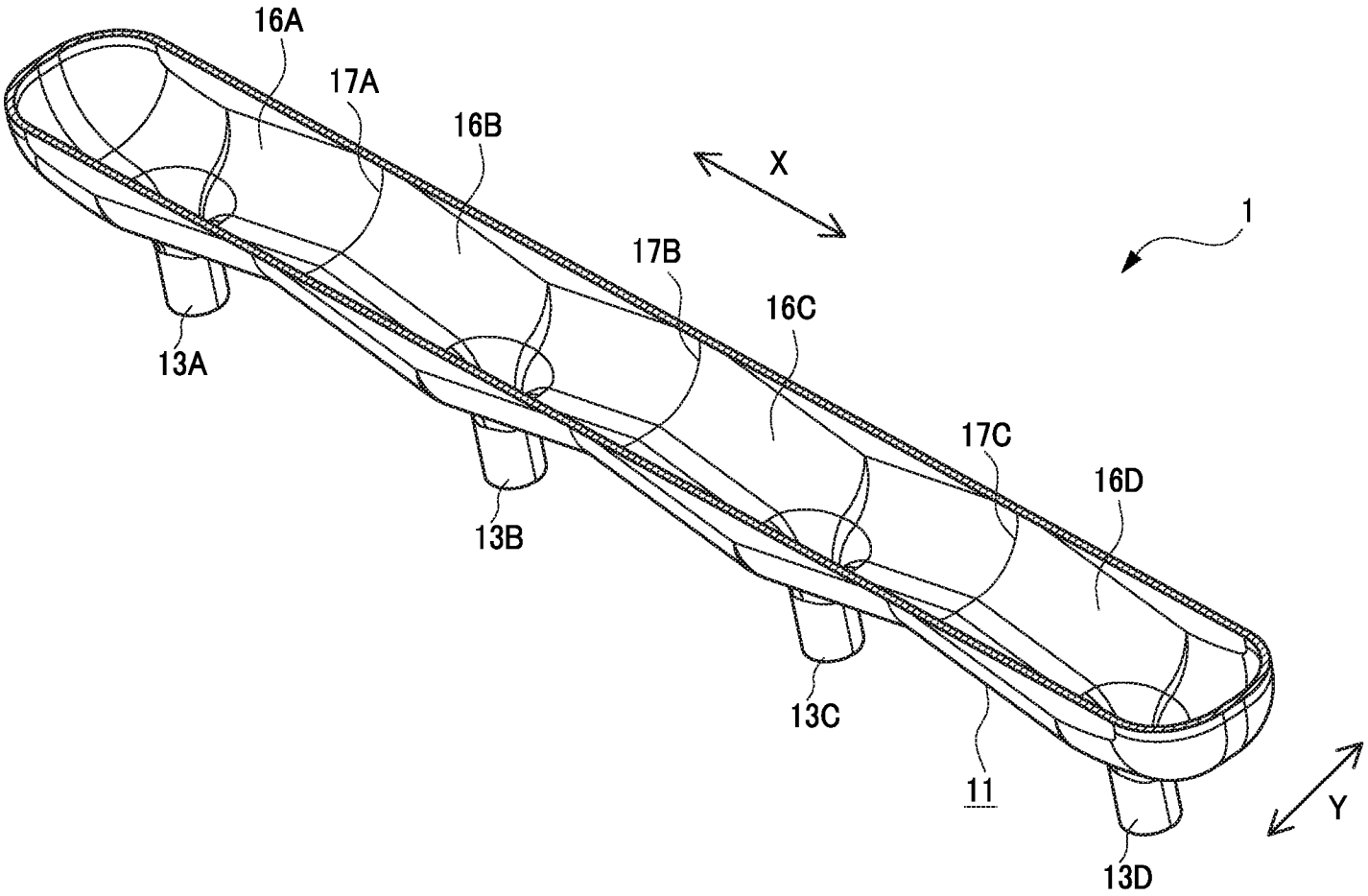
FIG. 10 is a perspective view of the cross-sectional view of the EGR gas distributor in FIG. 9 in the first embodiment.

FIG. 2 is a perspective view of the EGR gas distributor 1. FIG. 3 is a front view of the EGR gas distributor 1. FIG. 4 is a plan view of the EGR gas distributor 1. FIG. 5 is a cross-sectional view of the EGR gas distributor 1 taken along a line A-A in FIG. 4. FIG. 6 is a perspective view of the cross-sectional view of the EGR gas distributor 1 in FIG. 5. FIG. 7 is a cross-sectional view of the EGR gas distributor 1 taken along a line B-B in FIG. 3. FIG. 8 is a perspective view of the cross-sectional view of the EGR gas distributor 1 in FIG. 7. FIG. 9 is a cross-sectional view of the EGR gas distributor 1 taken along a line C-C in FIG. 3. FIG. 10 is a perspective view of the cross-sectional view of the EGR gas distributor 1 in FIG. 9. The intake manifold 2 and the EGR gas distributor 1 illustrated in FIGS. 1 to 10 are only examples provided with the basic configuration of the present disclosure, and their external appearances and shapes are also merely examples.

As shown in FIGS. 2 to 4, the EGR gas distributor 1 is of an oblong cylindrical shape as a whole and is placed to traverse a plurality of the branch pipes 4 of the intake manifold 2 in its longitudinal direction X. Further, as shown in FIGS. 2 to 10, the EGR gas distributor 1 of the present embodiment is formed of a single casing as a whole, but may be formed by joining a plurality of divided casings one another.

In FIGS. 2 to 10, the EGR gas distributor 1 of the present embodiment is formed of resin and formed integrally in advance with the intake manifold 2 (the branch pipes 4), which is not shown in the figures. As shown in FIG. 2 and FIG. 3, this EGR gas distributor 1 is configured with largely-divided three types of components of one gas chamber 11, one gas inflow passage 12, and a plurality (four) of gas outflow passages 13A, 13B, 13C, and 13D.

The gas chamber 11 is made to be collected with the EGR gas therein. The gas chamber 11 is of an oblong cylindrical shape and has an external appearance of curved bulges arranged in series. The gas inflow passage 12 is a passage for introducing the EGR gas into the gas chamber 11 on an upstream side (an upper side) of the gas chamber 11. In the present embodiment, the gas inflow passage 12 includes an inlet 12*a* connected to an EGR passage (not shown) and is of a bifurcated shape continuous with the inlet 12*a*. The gas outflow passages 13A to 13D are passages to discharge and distribute the EGR gas in the gas chamber 11 to a plurality of the branch pipes 4 constituting the intake manifold 2. In the present embodiment, the gas outflow passages 13A to 13D extend from the gas chamber 11 toward the branch pipes 4 located below the gas chamber 11.

As shown in FIG. 5, FIG. 6, FIG. 9, and FIG. 10, an inner wall inside the gas chamber 11 on a downstream side (on a lower side in the figures) is divided into a plurality (four) of downstream-side divided walls 16A, 16B, 16C, and 16D (an area indicated with chain double-dotted arrows in FIG. 5) each corresponding to the respective gas outflow passages 13A to 13D. Further, the respective downstream-side divided walls 16A to 16D are formed to be slanted downward to converge to the respective inlets 13*a* of the corresponding gas outflow passages 13A to 13D. The downstream-side divided walls 16A to 16D include a plurality (three) of downstream-side dividing ridges 17A, 17B, and 17C as boundaries for the adjacent downstream-side divided walls 16A to 16D.

To be specific, the downstream-side divided walls 16A to 16D are arranged in series in the longitudinal direction X of the gas chamber 11 and adjacent to one another. Further, the respective downstream-side divided walls 16A to 16D are slanted downward to converge to the corresponding inlets 13*a* of the gas outflow passages 13A to 13D. Thus, the boundaries of the adjacent downstream-side divided walls 16A to 16D are formed with ridge-like downstream-side dividing ridges 17A to 17C. Herein, the downstream-side divided walls 16A to 16D are almost linearly slanted toward the corresponding inlets 13*a* in the longitudinal direction X indicated in FIG. 5 and FIG. 6 and curvedly slanted in a short-side direction (traverse direction) Y indicated in FIG. 9 and FIG. 10. In the present embodiment, surface areas of the downstream-side divided walls 16A to 16D are each set to be approximated to one another.

Further, as shown in FIG. 5, FIG. 6, FIG. 7, and FIG. 8, an inner wall on the upstream side (an upper side in the figures) of the gas chamber 11 is placed to face the inner wall on the downstream side and divided into large upstream-side divided walls (an area indicated with chain double-dotted arrows in FIG. 5) 18A, 18B, 18C, and 18D at the same number (four) with the downstream-side divided walls 16A to 16D, and a plurality (three) of small upstream-side divided walls (indicated with other chain double-dotted arrows in FIG. 5) 19A, 19B, 19C formed between the adjacent upstream-side divided walls 18A to 18D, respectively. The large upstream-side divided walls 18A to 18D are each placed to face each of the inlets 13*a* of the gas outflow passages 13A to 13D. Further, tip portions 18*a* of the upstream-side divided walls 18A to 18D and tip portions 19*a* of the upstream-side divided walls 19A to 19C are each shaped to be curved to protrude outside (upward) of the gas chamber 11. The large upstream-side divided walls 18A to 18D include a plurality (six) of upstream-side ridges 20A, 20B, 20C, 20D, 20E, and 20F as boundaries of the adjacent small upstream-side divided walls 19A to 19C. These upstream-side ridges 20A to 20F are provided at least one in each area (each extent indicated with the chain double-dotted arrow in FIG. 5) corresponding to the respective downstream-side divided walls 16A to 16D in a manner that the upstream-side ridges 20A to 20F protrude toward the respective walls 16A to 16D and are arranged continuously in an arrangement orientation of the downstream-side dividing ridges 17A to 17C (in a direction of arranging side by side, namely in the short-side direction Y). In the present embodiment, the upstream-side ridges 20A to 20F are formed to be of ridge-like shape as similar to the downstream-side dividing ridges 17A to 17C. Further, as shown in FIG. 5, the upstream-side ridges 20A to 20F and the downstream-side dividing ridges 17A to 17C are displaced from one another in the longitudinal direction X so that the ridges 20A to 20F and the ridges 17A to 17C do not face one another. The upstream-side ridges 20A to 20F correspond to one example of an upstream-side protruding portion of the present disclosure.

Further specifically, the upstream-side divided walls 18A to 18D and 19A to 19C are arranged in series in the longitudinal direction X of the gas chamber 11 and adjacent to one another. Further, the large upstream-side divided walls 18A to 18D are placed to face the inlets 13*a* of the corresponding gas outflow passages 13A to 13D, respectively, while the small upstream-side divided walls 19A to 19C are placed to face the downstream-side dividing ridges 17A to 17C, respectively. Accordingly, in each boundary of the adjacent upstream-side divided walls 18A to 18D and the upstream-side divided walls 19A to 19C, the ridge-like upstream-side ridges 20A to 20F are formed. Herein, both in the longitudinal direction X indicated in FIG. 5 and FIG. 6 and in the short-side direction Y indicated in FIG. 7 and FIG. 8, each of the upstream-side divided walls 18A to 18D and 19A to 19C has the tip portion 18*a* or 19*a* that is shaped to be curved to protrude outside (upward) of the gas chamber 11. Further, the upstream-side divided walls 19A and 19C among the three upstream-side divided walls 19A to 19C located on both ends of the gas chamber 11 have openings to which outlets 12*b* of the bifurcated gas inflow passage 12 open.

Further, in the present embodiment, as shown in FIG. 5, total surface areas of the adjacent walls of the upstream-side divided walls 18A to 18D and the upstream-side divided walls 19A to 19C are facing the downstream-side divided walls 16A to 16D (surface areas each partitioned by vertical lines L1, L2, and L3 extending through the downstream-side dividing ridges 17A to 17C in FIG. 5) are made to be approximated to one another. Specifically, a total surface area of the upstream-side divided wall 18A with a half of the upstream-side divided wall 19A, a total surface area of the other half part of the upstream-side divided wall 19A, the upstream-side divided wall 18B, and a half of the upstream-side divided wall 19B, a total surface area of the other half part of the upstream-side divided wall 19B, the upstream-side divided wall 18C, and a half of the upstream-side divided wall 19C, and a total surface area of the other half part of the upstream-side divided wall 19C and the upstream-side divided wall 18D are set to be approximated to one another.

(Operations and Effects of EGR Gas Distributor)

Figure 11:
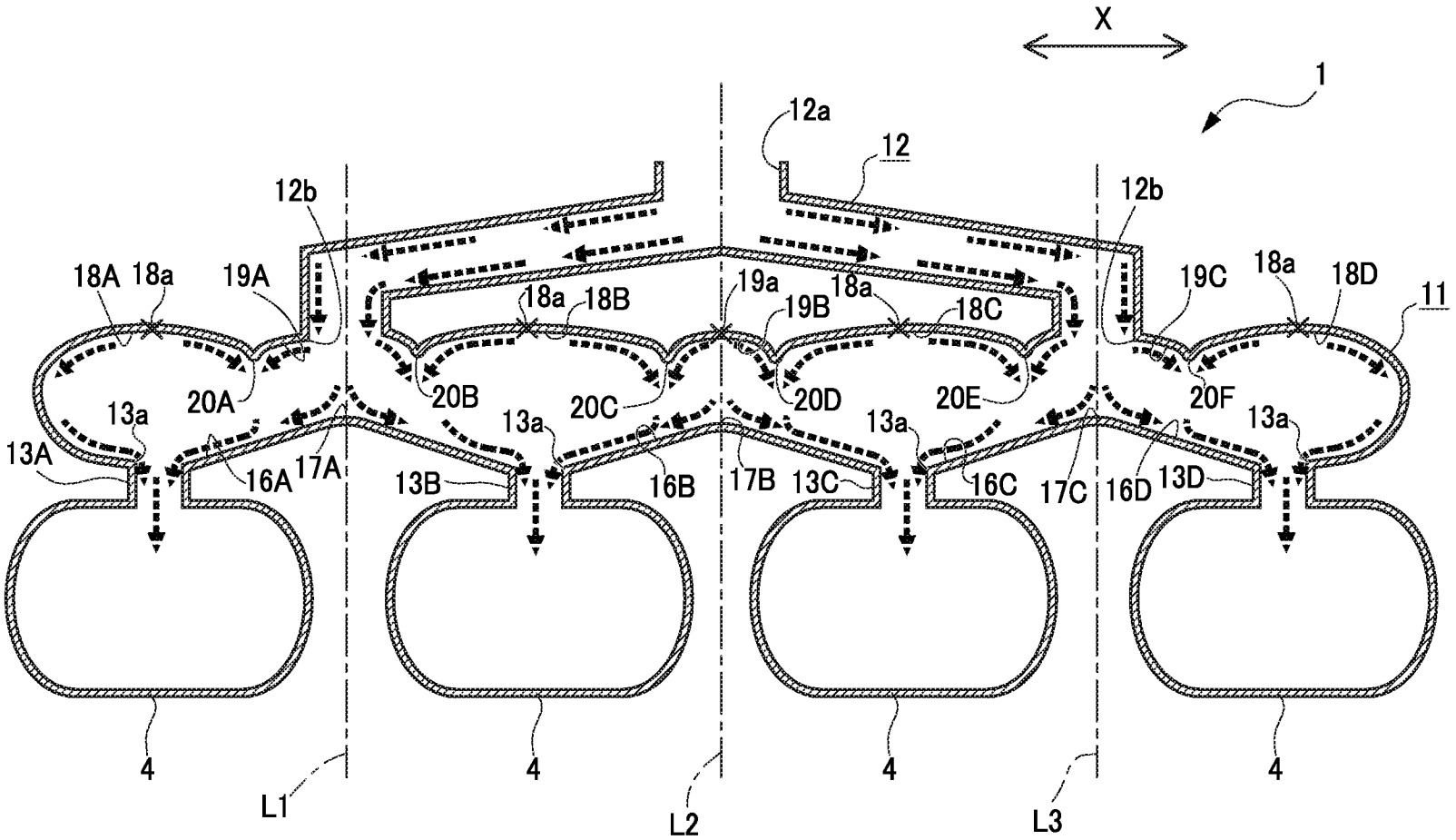
FIG. 11 is a sectional view of condensed water flow in the EGR gas distributor in the first embodiment taken along a line D-D in FIG. 1.

According to the configuration of the above-explained EGR gas distributor 1 of the present embodiment, as shown in FIG. 1, the EGR gas distributor 1 is provided on the upper side of the branch pipes 4 of the intake manifold 2 such that an upstream side of the gas chamber 11 is located on an upper side and a downstream side is located on a lower side. FIG. 11 is a sectional view showing flow of condensed water in the EGR gas distributor 1 taken along a line D-D in FIG. 1. In a state shown in FIG. 11, on the downstream side (on the lower side) of the gas chamber 11, each of the downstream-side divided walls 16A to 16D divided as corresponding to each of the gas outflow passages 13A to 13D is slanted and converges to each inlet 13*a* of the corresponding gas outflow passages 13A to 13D. Accordingly, as indicated with broken arrows in FIG. 11, on the downstream side (on the lower side) of the gas chamber 11, the condensed water generated in the divided respective downstream-side divided walls 16A to 16D hardly flows into other downstream-side divided walls 16A to 16D and only flows downward to the corresponding inlet 13*a* of any one of the gas outflow passages 13A to 13D. The condensed water flowing downward to the respective gas outflow passages 13A to 13D is sucked into the corresponding cylinders of the engine through the corresponding branch pipe 4. On the other hand, on an upstream side (on an upper side) of the gas chamber 11, an inner wall on the upstream side placed to face the inner wall on the downstream side (on the lower side) is provided with at least one of the upstream-side ridges 20A to 20F provided in each area corresponding to the respective downstream-side divided walls 16A to 16D, the ridges 20A to 20F protruding toward the respective downstream-side divided walls 16A to 16D and being continuously arranged in an arrangement direction of the respective downstream-side ridges 17A to 17C. Accordingly, as indicated with the broken arrows in FIG. 11, the condensed water generated on the inner wall (the respective upstream-side divided walls 18A to 18D, 19A to 19C) on the upstream side (the upper side) of the gas chamber 11 is easy to flow down to the downstream-side divided walls 16A to 16D from the upstream-side ridges 20A to 20F, and further easy to flow downward to the inlets 13*a* of the corresponding gas outflow passages 13A to 13D. Therefore, the condensed water generated in the gas chamber 11 can be positively distributed and discharged to the gas outflow passages 13A to 13D, and the condensed water generated on the inner wall (the upstream-side divided walls 18A to 18D, 19A to 19C) on the upstream side of the gas chamber 11 can be distributed and discharged to each of the gas outflow passages 13A to 13D without being concentrated in specified portions. For example, even when a vehicle mounted with this EGR gas distributor 1 performs repetitive short trips, it is possible to prevent the condensed water of a certain amount or more (the condensed water adhered to the inner wall of the gas chamber 11 by surface tension) from residing in the gas chamber 11 and to discharge the condensed water to each cylinder of the engine. Furthermore, this configuration can achieve preventing the condensed water from concentratedly flowing at once to a specified branch pipe 4, specifically to a specified cylinder, so that misfire on the engine due to inflow of a large amount of the condensed water can be prevented.

According to the configuration of the present embodiment, the upstream-side ridges 20A to 20F protrude toward the downstream-side divided walls 16A to 16D and are continuously arranged in an arrangement direction of the downstream-side dividing ridges 17A to 17C in the gas chamber 11, and thus the condensed water generated on the inner wall on the upstream side hardly flows in the adjacent inner wall over each of the upstream-side ridges 20A to 20F. Therefore, the condensed water generated on the inner wall on the upstream side in each area corresponding to each of the downstream-side divided walls 16A to 16D can be restrained from moving to the inner wall on the upstream side in the adjacent area over the upstream-side ridges 20A to 20F. As a result of this, distribution performance of distributing the condensed water to the respective branch pipes 4 (the respective cylinders) can be improved.

According to the configuration of the present embodiment, in the gas chamber 11, the downstream-side dividing ridges 17A to 17C provided in each space between the adjacent downstream-side divided walls 16A to 16D and the upstream-side ridges 20A to 20F provided on the inner wall on the upstream side (in each space between the adjacent upstream-side divided walls 18A to 18D, 19A to 19C) are displaced from one another so that they do not face. Accordingly, in the gas chamber 11, the condensed water dropping down from a specified one of the upstream-side ridges 20A to 20F drops down to the corresponding specified one of the downstream-side divided walls 16A to 16D but hardly drops down to other walls 16A to 16D. Therefore, the condensed water generated on the inner wall on the upstream side in each area corresponding to each of the downstream-side divided walls 16A to 16D is prevented from dropping down to the adjacent not-corresponding walls 16A to 16D from the upstream-side ridges 20A to 20F. As a result of this, the distribution performance of distributing the condensed water to the respective branch pipes 4 (each cylinder) can be improved.

Further, according to the configuration of the present embodiment, the inner wall on the upstream side of the gas chamber 11 is divided into a plurality of the upstream-side divided walls 18A to 18D and 19A to 19C by the upstream-side ridges 20A to 20F, and the tip portions 18*a* and 19*a* of the respective walls 18A to 18D and 19A to 19C are each of a curved protrusion-like shape protruding outward from the gas chamber 11. Accordingly, in the gas chamber 11, the condensed water generated in the thus divided upstream-side divided walls 18A to 18D and 19A to 19C tends to flow along the curved wall of the respective walls 18A to 18D and 19A to 19C to the corresponding upstream-side ridges 20A to 20F. Therefore, the condensed water generated on the inner wall on the upstream side of the gas chamber 11 can be made to actively flow to the corresponding upstream-side ridges 20A to 20F.

According to the configuration of the present embodiment, in the gas chamber 11, each surface area of the downstream-side divided walls 16A to 16D is approximated to one another, and thus the amount of the condensed water generated in the respective downstream-side divided walls 16A to 16D can be made equalized. Therefore, in the gas chamber 11, the amount of the condensed water flowing from the respective downstream-side divided walls 16A to 16D to the corresponding branch pipes 4, further to the respective cylinders of the engine can be equalized.

Further, according to the configuration of the present embodiment, in the gas chamber 11, the surface area of the inner wall on the upstream side in each area corresponding to each of the downstream-side divided walls 16A to 16D is approximated to one another, so that the amount of the condensed water generated on the inner wall in those corresponding areas tends to be equalized to one another. Therefore, in the gas chamber 11, equalization of the amount of the condensed water dropping down to each of the corresponding downstream-side divided walls 16A to 16D from the inner wall on the upstream side can be achieved. In this point of view, too, the amount of the condensed water flowing from the respective downstream-side divided walls 16A to 16D to the corresponding branch pipes 4, further to the respective cylinders of the engine can be equalized.

Second Embodiment

A second embodiment is now explained. In the following explanation, similar or identical parts and components to those of the first embodiment are assigned with the same reference signs as those in the first embodiment and their explanations are omitted, and the explanation is made with a focus on the differences from the first embodiment.

Figure 12:
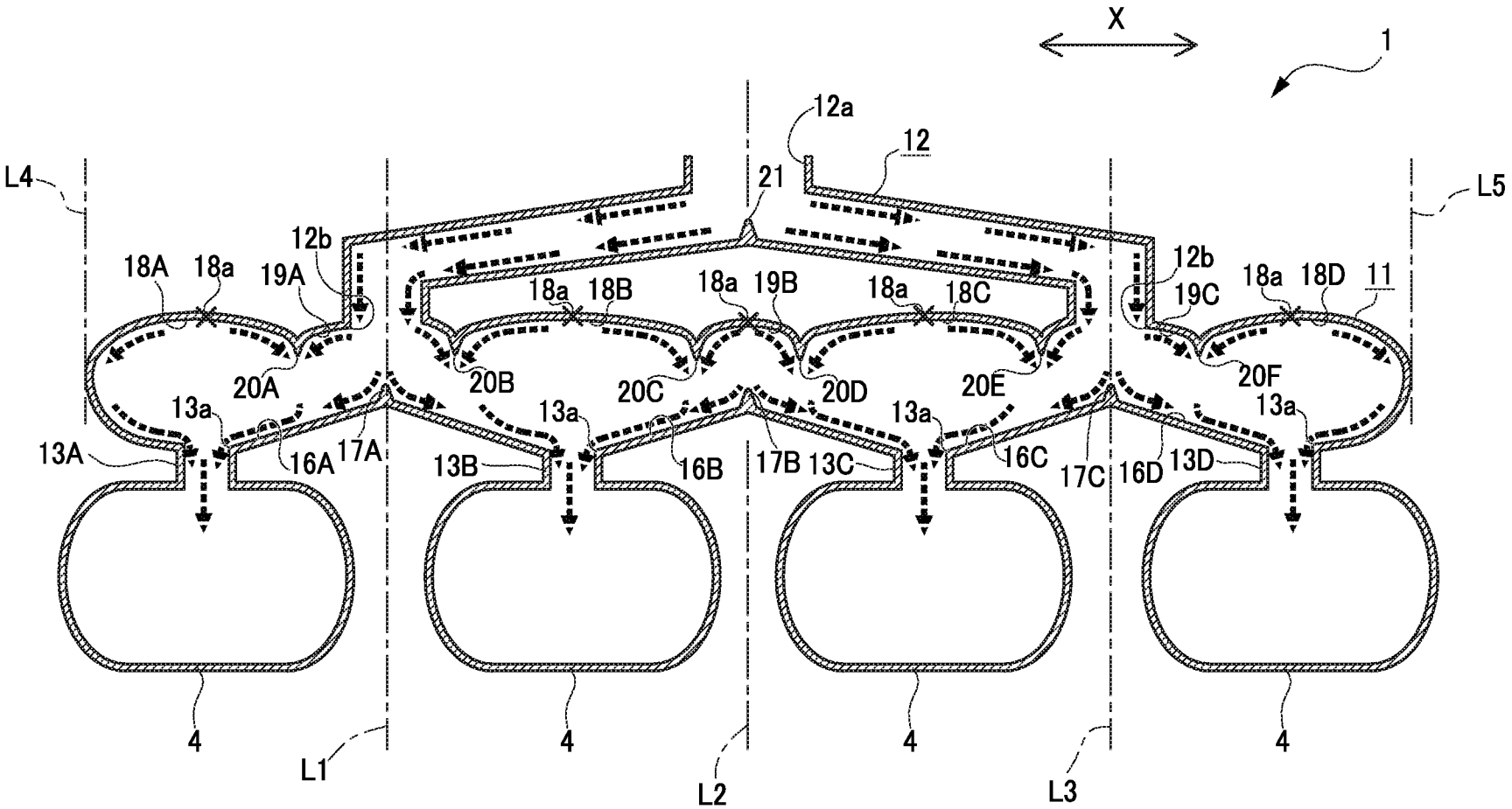
FIG. 12 is a sectional view equivalent to FIG. 11, showing the flow of the condensed water in the EGR gas distributor in a second embodiment.

FIG. 12 is a sectional view equivalent to FIG. 11, showing flow of condensed water in an EGR gas distributor 1. The present embodiment is different from the first embodiment in a configuration of upstream-side ridges 20A to 20F and downstream-side dividing ridges 17A to 17C in a gas chamber 11. Specifically, as shown in FIG. 12, the upstream-side ridges 20A to 20F are of fence-like shape protruding downward, and the downstream-side dividing ridges 17A to 17C are of fence-like shape protruding upward. In addition, in the present embodiment, there is provided a protruding ridge 21 in an inside of a gas inflow passage 12 protruding upward from an inner wall of a passage branch point directly below an inlet 12*a*. The present embodiment is different from the first embodiment in those configurations.

Accordingly, the configuration of the present embodiment can obtain the following operations and effects in addition to the operations and the effects of the first embodiment. Specifically, in the present embodiment, the upstream-side ridges 20A to 20F in the gas chamber 11 are of the fence-like shape to protrude downward, so that the condensed water, which is generated on the inner wall on the upstream side to flow downward along the curved wall of the upstream-side divided walls 18A to 18D and 19A to 19C, further easily drops downward from the upstream-side ridges 20A to 20F. Namely, when the condensed water flowing downward along the curved wall of the respective upstream-side divided walls 18A to 18D and 19A to 19C reaches the respective upstream-side ridges 20A to 20F, the condensed water is guided downward along the shape of the ridges 20A to 20F, thereby further easily dropping directly down from a leading end of the respective ridges 20A to 20F. Therefore, in the gas chamber 11, the condensed water generated on the inner wall on the upstream side of each area corresponding to the respective downstream-side divided walls 16A to 16D can be further positively dropped off to the walls 16A to 16D, thereby further restraining drop of the condensed water to the not-corresponding adjacent downstream-side divided walls 16A to 16D.

Further, according to the configuration of the present embodiment, the downstream-side dividing ridges 17A to 17C in the gas chamber 11 are of fence-like shape, and thus the condensed water generated in the downstream-side divided walls 16A to 16D hardly crosses over the dividing ridges 17A to 17C and moves further to the adjacent downstream-side divided walls 16A to 16D. Therefore, in the gas chamber 11, the condensed water generated in the respective downstream-side divided walls 16A to 16D is further assuredly prevented from moving to the adjacent downstream-side divided walls 16A to 16D.

Further, according to the configuration of the present embodiment, the protruding ridge 21 is formed on the inner wall at the passage branch point of the gas inflow passage 12, so that the condensed water generated in the gas inflow passage 12 hardly moves to the adjacent branch passages over the protruding ridge 21. Therefore, the condensed water generated in the gas inflow passage 12 can be equally divided into the two branch passages.

Third Embodiment

Figure 13:
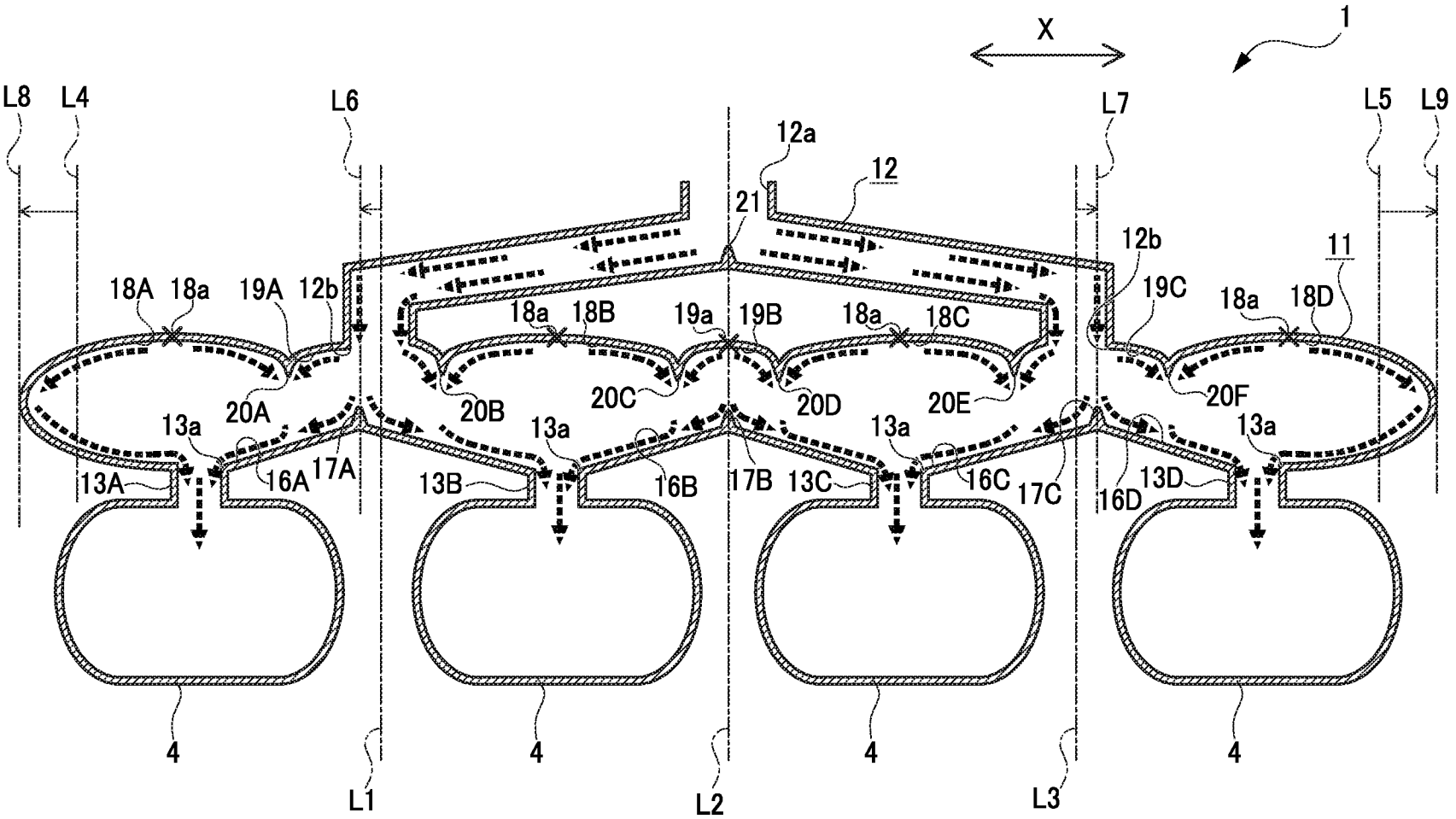
FIG. 13 is a sectional view equivalent to FIG. 12, showing the flow of the condensed water in the EGR gas distributor in a third embodiment.

A third embodiment is now explained. FIG. 13 is a sectional view equivalent to FIG. 12, showing flow of condensed water in an EGR gas distributor 1 according to the present embodiment. The present embodiment is different from the previous embodiments in its shape of the gas chamber 11 in which bulges on both ends are made enlarged in a longitudinal direction X. Specifically, as shown in FIG. 13, a bulge corresponding to a gas outflow passage 13A (on a left end in FIG. 13) of the gas chamber 11 is enlarged outward larger than a bulge on a left end in FIG. 12 by an extent from a vertical line L4 to a vertical line L8. Similarly, a bulge corresponding to a gas outflow passage 13D (on a right end in FIG. 13) is enlarged outward larger than a right end in FIG. 12 by an extent from a vertical line L5 to a vertical line L9.

Furthermore, in the present embodiment, a downstream-side dividing ridge 17A is offset or displaced from a position of the downstream-side dividing ridge 17A in FIG. 12 by an extent from a position on a vertical line L1 to a position on a vertical line L6 in accordance with the above-mentioned enlarged bulges. Further, in the present embodiment, the downstream-side dividing ridge 17C is offset or displaced from a position of the downstream-side dividing ridge 17C in FIG. 12 by an extent from a position on a vertical line L3 to a position on a vertical line L7. The downstream-side dividing ridges 17A and 17C are thus offset in accordance with increase in the bulges of the gas chamber 11 in order to approximate surface areas of the respective downstream-side divided walls 16A to 16D and to also approximate surface areas of inner walls on an upstream side in the respective areas corresponding to each of the downstream-side divided walls 16A to 16D (constituted by the adjacent upstream-side divided walls 18A to 18D and 19A to 19C) one another.

Accordingly, according to the configuration of the present embodiment, the similar operations and effects to those of the second embodiment can be obtained.

Fourth Embodiment

Figure 14:
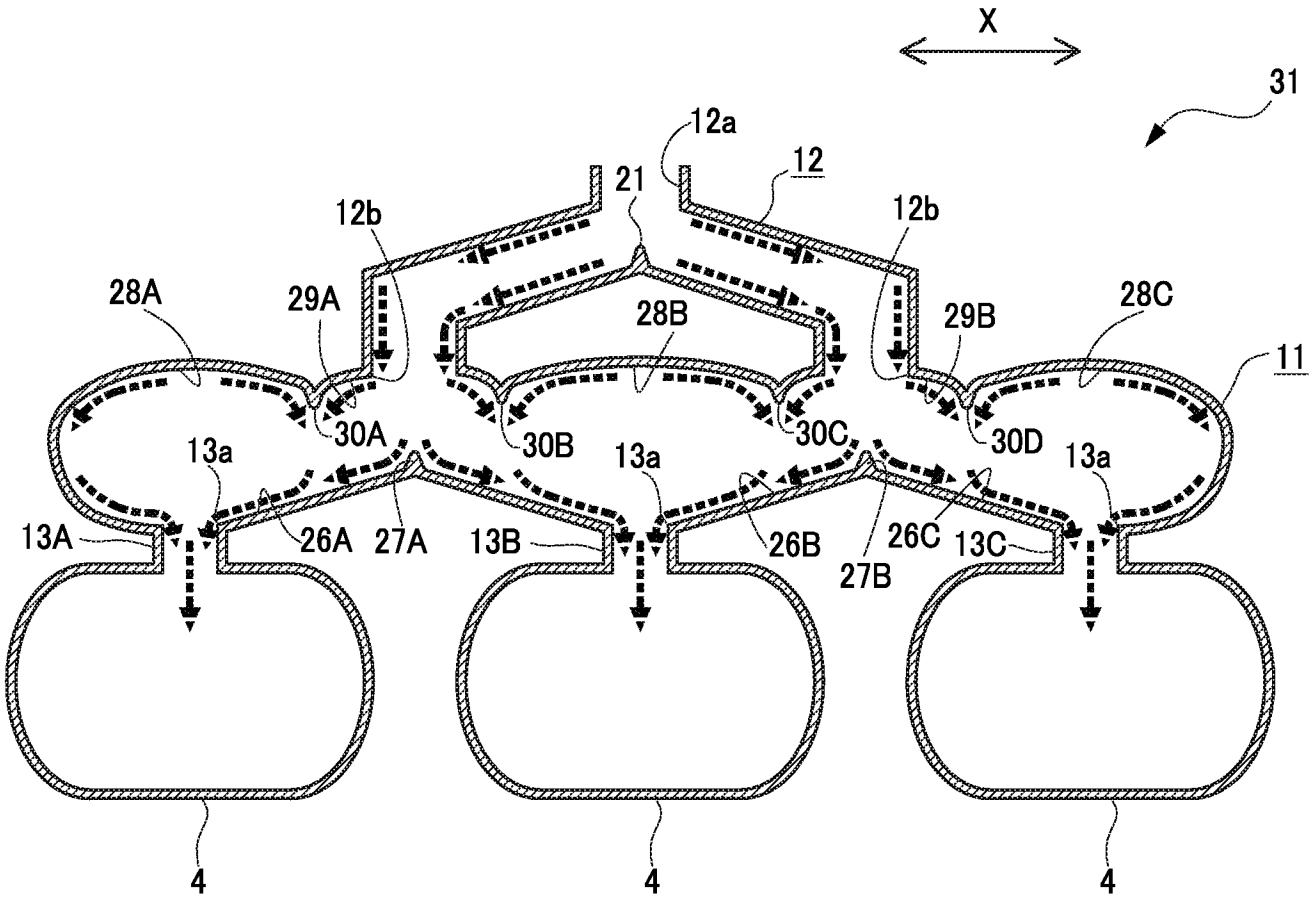
FIG. 14 is a sectional view equivalent to FIG. 12, showing the flow of the condensed water in the EGR gas distributor in a fourth embodiment.

A fourth embodiment is now explained. FIG. 14 is a sectional view equivalent to FIG. 12, showing flow of condensed water in an EGR gas distributor 31 according to the present embodiment. The EGR gas distributor 31 of the present embodiment is different from the EGR gas distributor 1 in the second embodiment in a manner that the distributor 31 is provided in an intake manifold including three branch pipes 4 in correspondence with an engine provided with three cylinders. In FIG. 14, a gas chamber 11 is provided with three downstream-side divided walls 26A to 26C, two downstream-side dividing ridges 27A and 27B, three large upstream-side divided walls 28A to 28C, two small upstream-side divided walls 29A and 29B, and four upstream-side ridges 30A to 30D. The upstream-side ridges 30A to 30D correspond to an upstream-side protruding portion of the present disclosure.

Accordingly, according to the configuration of the present embodiment, the gas distributor has different size and shape from the second embodiment, but the similar operations and effects can be obtained.

Fifth Embodiment

Figure 15:
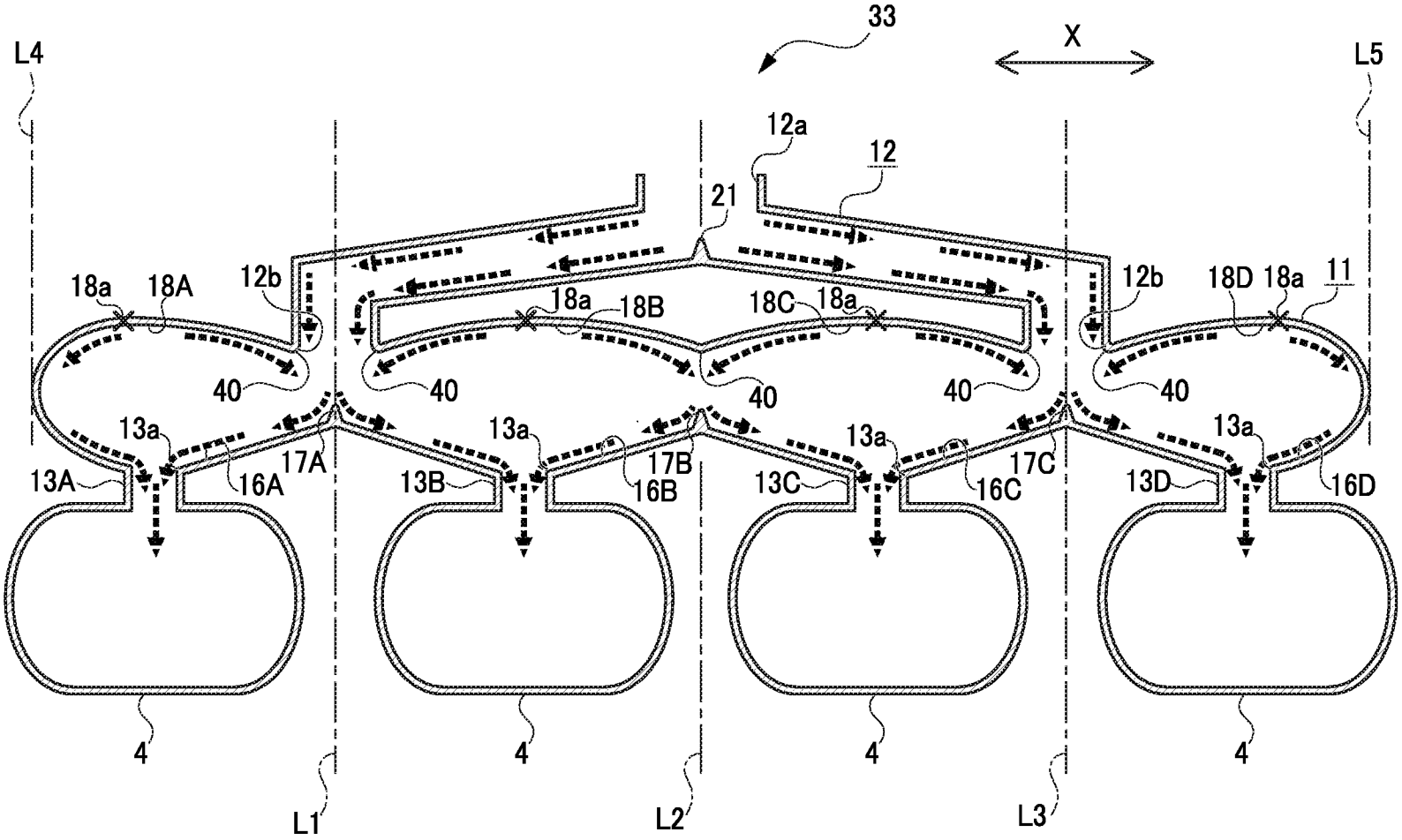
FIG. 15 is a sectional view equivalent to FIG. 12, showing the flow of the condensed water in the EGR gas distributor in a fifth embodiment.

A fifth embodiment is now explained. FIG. 15 is a sectional view equivalent to FIG. 12, showing flow of condensed water in an EGR gas distributor 33 according to the present embodiment. The EGR gas distributor 33 of the present embodiment is different from the EGR gas distributors 1 and 31 in the above-mentioned embodiments in a manner that small upstream-side divided walls 19A to 19C, 29A, and 29B are omitted from an inner wall on an upstream side.

To be more specific, in FIG. 15, the inner wall on the upstream side in a gas chamber 11 is placed to face an inner wall on a downstream side and divided into upstream-side divided walls 18A to 18D at the same number with downstream-side divided walls 16A to 16D. Each one of the upstream-side divided walls 18A to 18D is placed to face each inlet 13*a* of a plurality of gas outflow passages 13A to 13D, and the upstream-side divided walls 18A to 18D have tip portions 18*a* of protrusion-like curved shape protruding outward from the gas chamber 11.

In FIG. 15, surface areas of the upstream-side divided walls 18A to 18D are made to be approximated to one another. Further, the upstream-side divided walls 18A to 18D are provided with a plurality (five) of upstream-side ridges 40 as boundaries for the adjacent walls 18A to 18D. In FIG. 15, one upstream-side divided ridge 40 is provided in a center of the inner wall on the upstream side and two ridges 40 are provided each on lower ends of outlets 12*b* of the gas inflow passage 12. In the present embodiment, the respective upstream-side ridges 40 are placed to face the corresponding downstream-side dividing ridges 17A to 17C (of fence-like shape). The upstream-side ridges 40 of the present embodiment are formed to be ridge-like shape on the respective boundaries of the adjacent upstream-side divided walls 18A to 18D as similar to the upstream-side ridges 20A to 20F of the first embodiment, but not to be of fence-like shape protruding downward like the upstream-side ridges 20A to 20F of the second to fourth embodiments. However, the upstream-side ridges 40 may be of fence-like shape protruding downward. The upstream-side ridges 40 correspond to one example of the upstream-side protruding portion of the present disclosure.

Accordingly, according to the configuration of the present embodiment, the forming of the gas chamber 11 may be simplified by omitting the configuration of the small upstream-side divided walls from the inner wall on the upstream side in the gas chamber 11. The present embodiment can obtain the similar operations and effects to those of the previous embodiments as for other operations and effects.

As shown in FIG. 15, in the present embodiment, the upstream-side ridge 40 provided on the center faces the downstream-side dividing ridge 17B (of fence-like shape) on a center. Therefore, the condensed water generated in the upstream-side divided wall 18B and the upstream-side divided wall 18C sandwiching the upstream-side ridge 40 on the center flows along the upstream-side ridge 40 on the center and drops downward from the upstream-side ridge 40, and then the condensed water could flow down to either one of the adjacent downstream-side divided wall 16B and the downstream-side divided wall 16C. On the other hand, the condensed water generated in the upstream-side divided wall 18A and the upstream-side divided wall 18D on both ends of the gas chamber 11 drops down to each of the corresponding downstream-side divided walls 16A and 16D on both ends without dropping down to the adjacent downstream-side divided walls 16B and 16C. Therefore, in the EGR gas distributor 33 of the present embodiment, even though some unbalanced distribution of the condensed water may occur, the distribution performance of the condensed water to the respective branch pipes 4 (the respective cylinders of the engine) can be improved as compared to the conventional EGR gas distributor.

Sixth Embodiment

Figure 16:
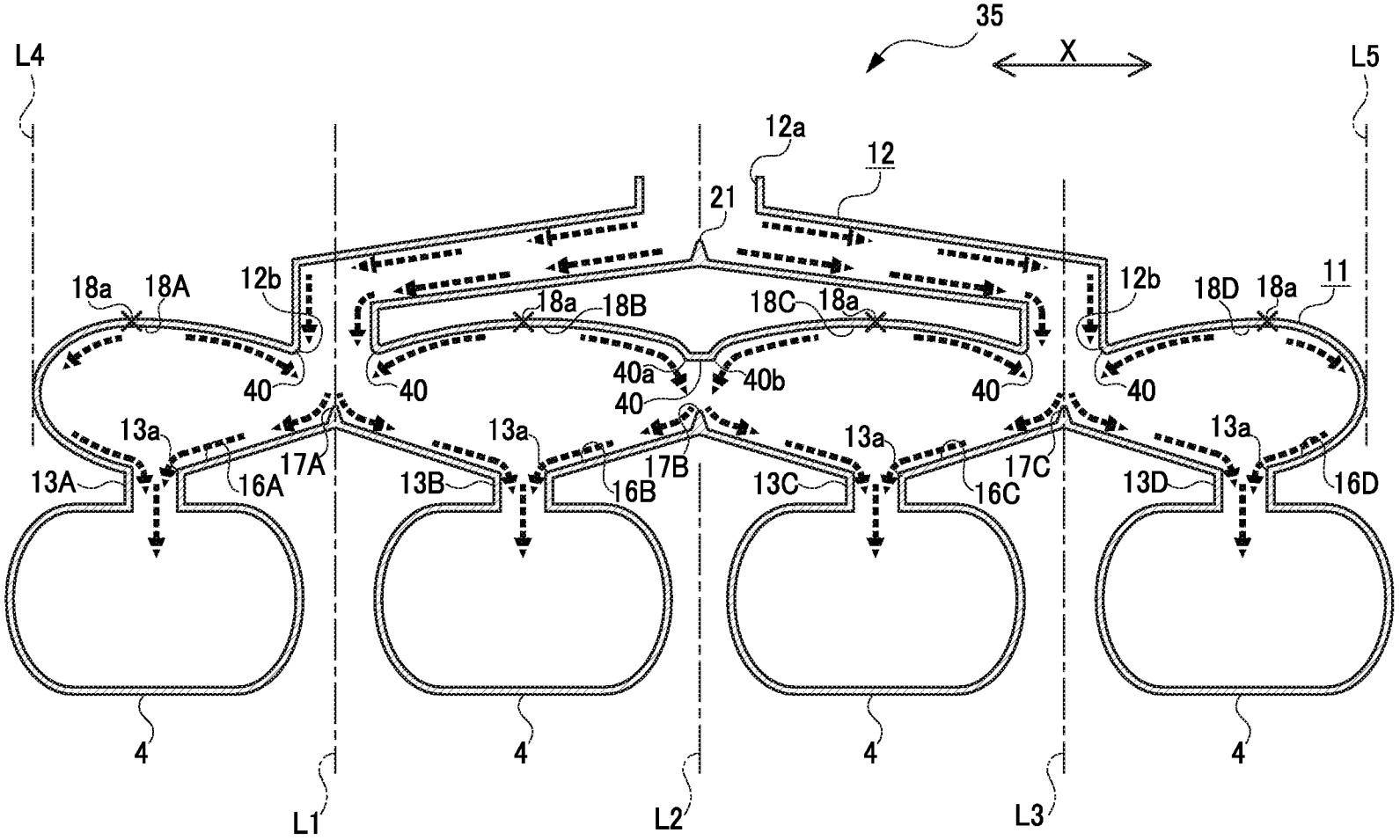
FIG. 16 is a sectional view equivalent to FIG. 12, showing the flow of the condensed water in the EGR gas distributor in a sixth embodiment.

A sixth embodiment is now explained. FIG. 16 is a sectional view equivalent to FIG. 15, showing flow of condensed water in an EGR gas distributor 35 of the present embodiment. The EGR gas distributor 35 of the present embodiment is different from the EGR gas distributor 33 of the fifth embodiment in a manner that the upstream-side ridge 40 on a center portion is made to enlarge its width.

Accordingly, in the configuration of the present embodiment, the upstream-side ridge 40 on the center is shaped wide, and thus one edge 40*a* of the ridge 40 is located closer to a side of the downstream-side divided wall 16B than the facing downstream-side dividing ridge 17B and the other edge 40*b* of the ridge 40 is located closer to a side of the downstream-side divided wall 16C than the facing downstream-side dividing ridge 17B. Therefore, the condensed water generated on the upstream-side divided wall 18B (facing the downstream-side divided wall 16B), which is one of the walls sandwiching the upstream-side ridge 40 on the center, drops down from one edge 40*a* of the upstream-side ridge 40 to the corresponding downstream-side divided wall 16B. Further, the condensed water generated on the upstream-side divided wall 18C (facing the downstream-side divided wall 16C), which is the other one of the walls sandwiching the upstream-side ridge 40, drops down from the other edge 40*b* of the upstream-side ridge 40 to the facing downstream-side divided wall 16C. Consequently, the EGR gas distributor 35 can improve its distribution performance of distributing the condensed water with respect to the respective branch pipes 4 (the respective cylinders of the engine) better than that of the fifth embodiment. As a result of this, the distribution performance of distributing the condensed water to the respective branch pipes 4 (the respective cylinders) can be improved as compared to the conventional EGR gas distributor.

Seventh Embodiment

Figure 17:
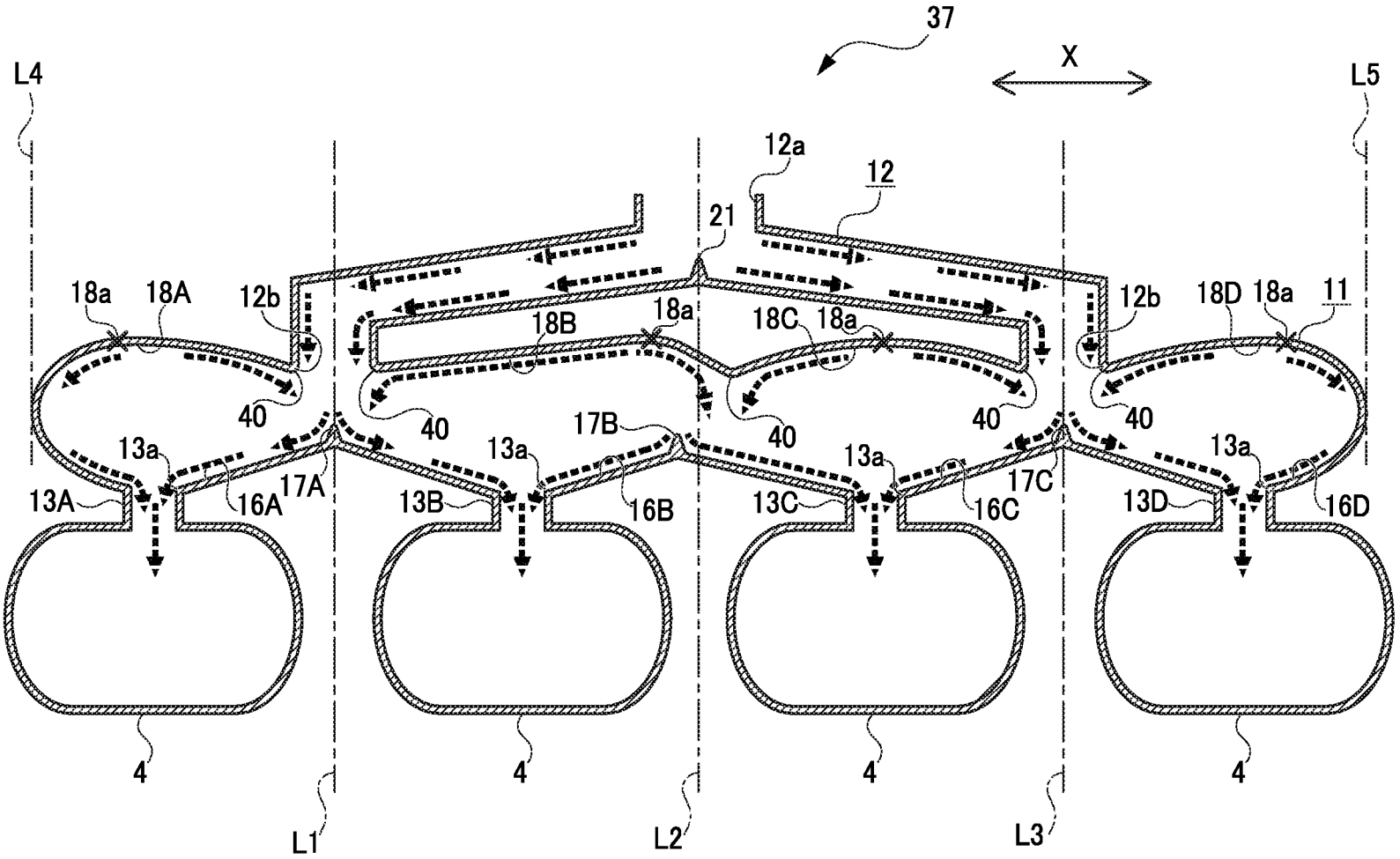
FIG. 17 is a sectional view equivalent to FIG. 12, showing the flow of the condensed water in the EGR gas distributor in a seventh embodiment.

A seventh embodiment is now explained. FIG. 17 is a sectional view equivalent to FIG. 15, showing flow of condensed water in an EGR gas distributor 37 of the present embodiment. The EGR gas distributor 37 of the present embodiment includes an upstream-side ridge 40 provided in its center displaced to face a downstream-side divided wall 16C (displaced to a right side in the figure) and includes a tip portion 18*a* of an upstream-side divided wall 18B which is one of walls (on a left side in the figure) sandwiching the upstream-side ridge 40 displaced from a center of the upstream-side divided wall 18B to come close to the upstream-side ridge 40. Those configurations are different from the configuration of the EGR gas distributor 33 of the fifth embodiment.

Accordingly, in the configuration of the present embodiment, the upstream-side ridge 40 on the center is displaced to face the downstream-side divided wall 16C, and the tip portion 18*a* of the upstream-side divided wall 18B that is one of the walls sandwiching the upstream-side ridge 40 is displaced from the center of the upstream-side divided wall 18B to come close to the upstream-side ridge 40, thereby causing imbalance in the flow of the condensed water generated on the upstream-side divided wall 18B. To be specific, in FIG. 17, in the upstream-side divided wall 18B, a left side of the tip portion 18*a* slanted leftward has an area larger than a right side in the figure, and the right side of the tip portion 18*a* is slanted rightward in the figure. Thus, a large amount of the condensed water generated on the upstream-side divided wall 18B flows to the left side of the wall 18B and thus drops down to the facing downstream-side divided wall 16B. On the other hand, among the condensed water generated on the upstream-side divided wall 18B, the condensed water flowing to the right side in the figure and dropping down to the facing downstream-side divided wall 16C has less amount than the water dropping down to the downstream-side divided wall 16B. This results in less differences in the amount of the condensed water dropping down to the facing downstream-side divided wall 16C from the upstream-side divided wall 18C, the amount of the condensed water dropping down to the facing downstream-side divided wall 16A from the upstream-side divided wall 18A, or the amount of the condensed water dropping down to the facing downstream-side divided wall 16D from the upstream-side divided wall 18D with respect to the amount of the condensed water dropping down to the facing downstream-side divided wall 16B from the upstream-side divided wall 18B. Therefore, the distribution of the condensed water to the respective branch pipes 4 (each cylinder of the engine) by the EGR gas distributor 37 can be improved from that of the fifth embodiment. Consequently, the distribution performance of distributing the condensed water to the respective branch pipes 4 (each cylinder of the engine) can be improved as compared to the conventional EGR gas distributor.

Eighth Embodiment

Figure 18:
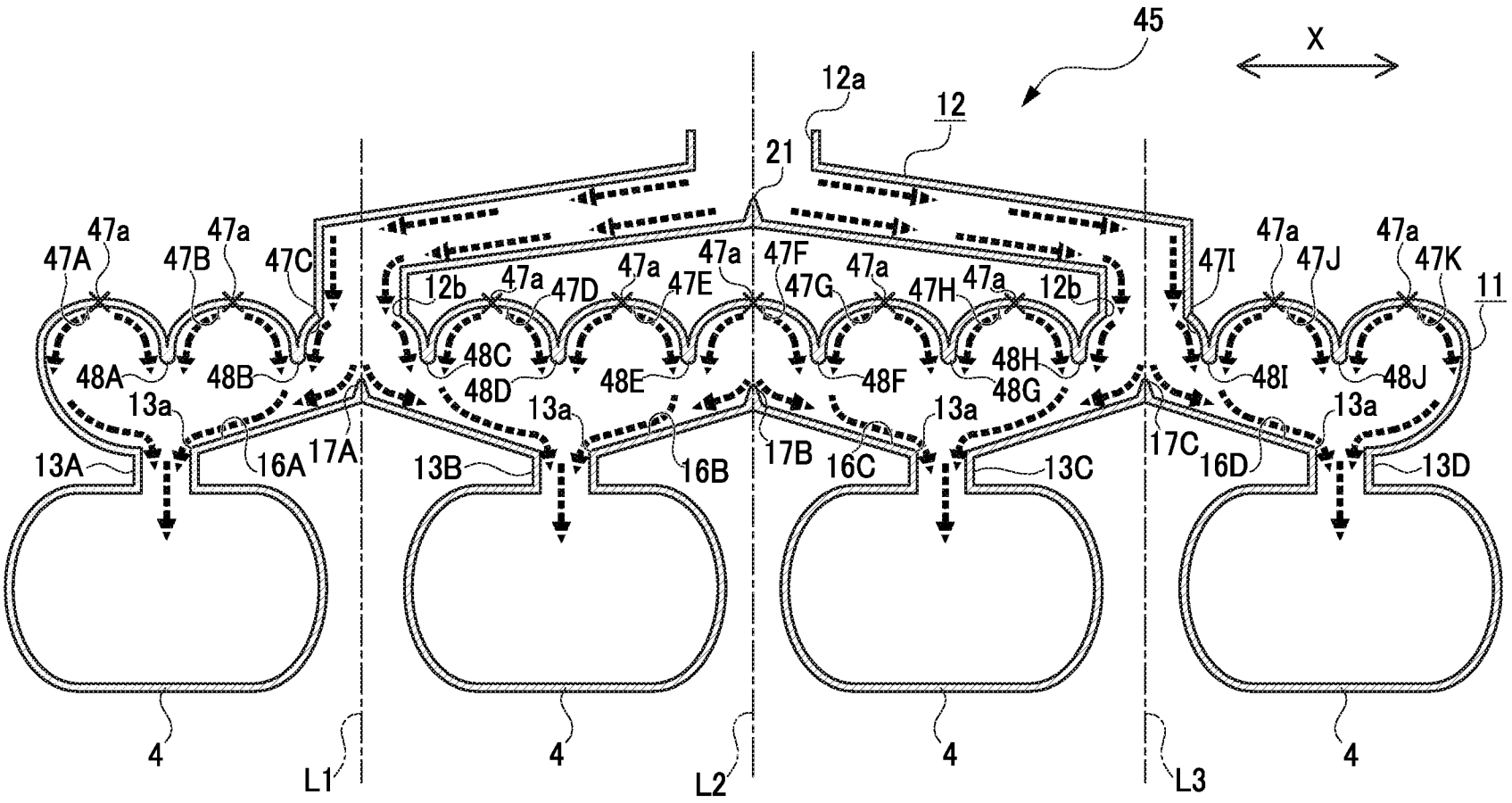
FIG. 18 is a sectional view equivalent to FIG. 12, showing the flow of the condensed water in the EGR gas distributor in an eighth embodiment.

An eighth embodiment is now explained. FIG. 18 is a sectional view equivalent to FIG. 12, showing flow of condensed water in an EGR gas distributor 45 of the present embodiment. The EGR gas distributor 45 of the present embodiment is different in its configuration of an inner wall on an upstream side in a gas chamber 11 from the EGR gas distributors 1, 31, 33, 35, and 37 of the second to seventh embodiments.

Specifically, in FIG. 18, an inner wall on an upstream side in the gas chamber 11 is divided into a plurality (eleven) of upstream-side divided walls 47A, 47B, 47C, 47D, 47E, 47F, 47G, 47H, 47I, 47J, and 47K which is the larger number than that of the downstream-side divided walls 16A to 16D but have almost same width in total. Some of these upstream-side divided walls 47A to 47K are placed to face inlets 13*a* of a plurality of gas inflow passages 13A to 13D, and some other walls are placed to face a plurality of downstream-side dividing ridges 17A to 17C. Further, the upstream-side divided walls 47A to 47K have tip portions 47*a* of protrusion-like curved shape protruding outward (upward) from the gas chamber 11. Further, spaces between the adjacent upstream-side divided walls 47A to 47K are provided with a plurality (ten) of upstream-side ridges 48A, 48B, 48C, 48D, 48E, 48F, 48G, 48H, 48I, and 48J as boundaries. These upstream-side ridges 48A to 48J protrude downward to the downstream-side divided walls 16A to 16D in each area (each area partitioned by downstream-side dividing ridges 17A to 17C in FIG. 18) corresponding to each of downstream-side divided walls 16A to 16D, and two or three of the ridges are consecutively provided in a direction (in a short-side direction Y) in which the respective downstream-side dividing ridges 17A to 17C are arranged. In the present embodiment, the upstream-side ridges 48A to 48J are of fence-like shape protruding downward. Further, the upstream-side ridges 48A to 48J and the downstream-side dividing ridges 17A to 17C are displaced form one another in the longitudinal direction X so that they do not face one another. These upstream-side ridges 48A to 48J correspond to one example of the upstream-side protruding portion of the present disclosure.

Further, as shown in FIG. 18, in the gas chamber 11 of the present embodiment, total surface areas (surface area in each section divided by the vertical lines L1, L2, and L3 in FIG. 18) of the adjacent three or four upstream-side ridges 47A to 47K each facing the downstream-side divided walls 16A to 16D are approximated to one another. Specifically, a total surface area of the upstream-side divided walls 47A and 47B with a half of the upstream-side divided wall 47C, a total surface area of the other half of the upstream-side divided wall 47C, the upstream-side divided walls 47D and 47E, and a half of the upstream-side divided wall 47F, a total surface area of the other half of the upstream-side divided wall 47F, the upstream-side divided walls 47G and 47H, and a half of the upstream-side divided wall 47I, and a total surface area of the other half of the upstream-side divided wall 47I and the upstream-side divided walls 47J and 47K are approximated to one another.

Accordingly, according to the configuration of the present embodiment, the configuration is different from those in the second to fourth embodiments in the size and the number of the upstream-side divided walls 47A to 47K and in the number of the upstream-side ridges 48A to 48J in the gas chamber 11. However, the configuration of the present embodiment is basically similar to the configuration of the second to the fourth embodiments, and thus can achieve the similar operations and effects to those of the second to the fourth embodiments.

Ninth Embodiment

Figure 19:
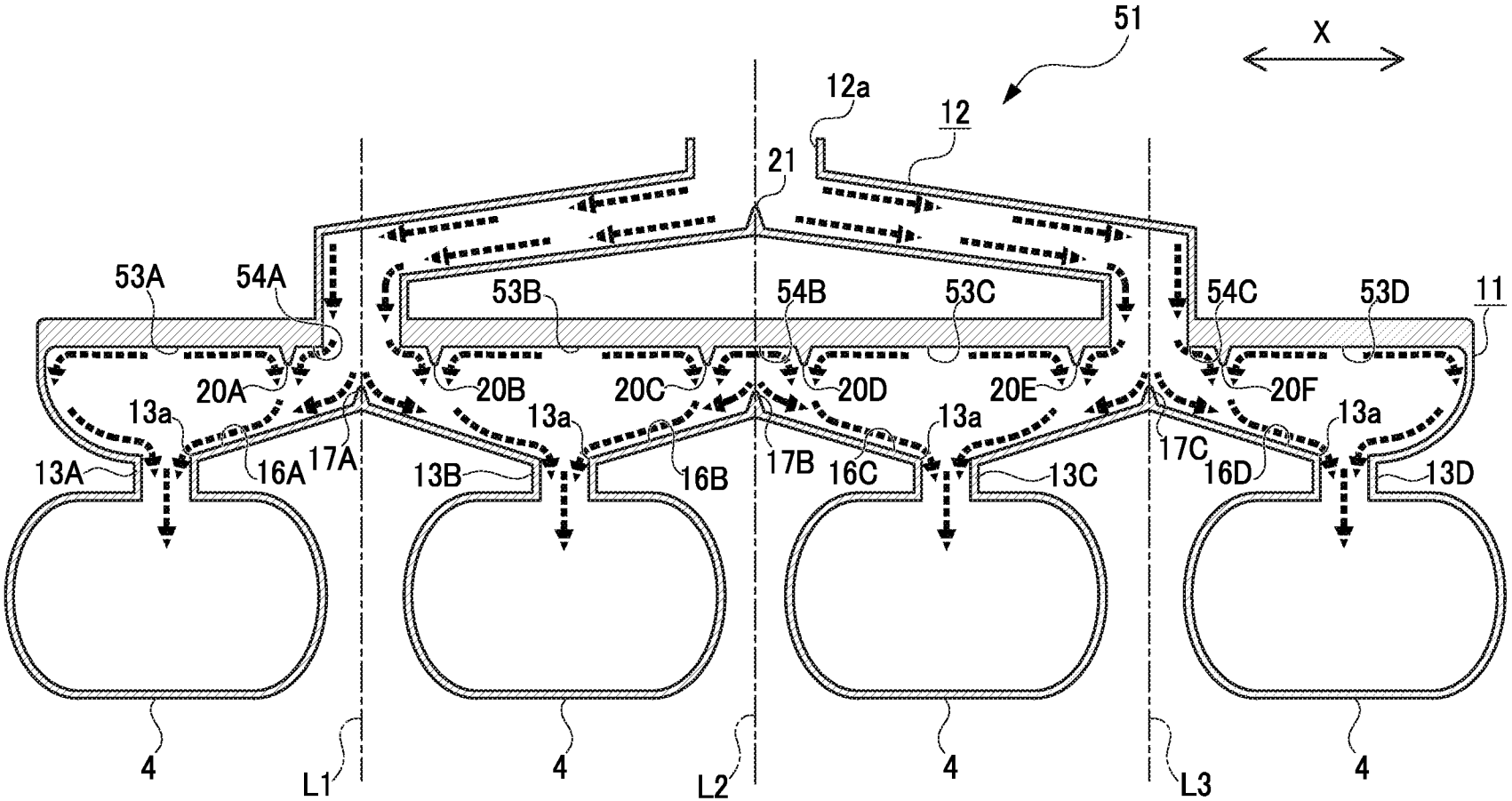
FIG. 19 is a sectional view equivalent to FIG. 12, showing the flow of the condensed water in the EGR gas distributor in a ninth embodiment.

A ninth embodiment is now explained. FIG. 19 is a sectional view equivalent to FIG. 12, showing flow of condensed water in an EGR gas distributor 51 of the present embodiment. The EGR gas distributor 51 of the present embodiment is different from the configuration of the EGR gas distributor of the second embodiment in the configuration of an inner wall on an upstream side in a gas chamber 11.

To be specific, as shown in FIG. 19, in the present embodiment, the inner wall on the upstream-side of the gas chamber 11 is placed to face the inner wall on the downstream side as similar to the second embodiment, and one or two of upstream-side ridges 20A to 20F are provided to protrude toward downstream-side divided walls 16A to 16D that are arranged continuously with the downstream-side dividing ridges 17A to 17C in each area corresponding to the respective downstream-side divided walls 16A to 16D. This configuration of displacing the upstream-side ridges 20A to 20F from the downstream-side dividing ridges 17A to 17C in the longitudinal direction X is as similar to the configuration of the second embodiment. Further, the configuration of dividing the inner wall on the upstream side in the gas chamber 11 into large upstream-side divided walls 53A, 53B, 53C, and 53D at the same number (four) with the downstream-side divided walls 16A to 16D and into the plural (three) small upstream-side divided walls 54A, 54B, and 54C each of which is placed between the adjacent upstream-side divided walls 53A to 53D is similar to the configuration of the second embodiment. However, the present embodiment is different from the second embodiment in its shape of the gas chamber 11 in a manner that the above-mentioned upstream-side divided walls 53A to 53D and 54A to 54C are shaped flat without being curved or slanted and that the outside wall on the upstream side (on the upper side) of the gas chamber 11 is also shaped flat.

Accordingly, according to the configuration of the present embodiment, the upstream-side divided walls 53A to 53D and 54A to 54C are shaped flat and at the same height in the gas chamber 11, so that the condensed water generated in these upstream-side divided walls 53A to 53D and 54A to 54C has no chance of flowing downward to the respective upstream-side ridges 20A to 20F. However, if the EGR gas distributor 51 is applied with oscillation and a centrifugal force, the condensed water subjected to the operation of the oscillation or the centrifugal force moves to the respective upstream-side ridges 20A to 20F and further drops and flows downward from the ridges 20A to 20F. Therefore, even though there is some differences from the second embodiment to a greater or lesser extent, the present embodiment can achieve the similar operations and effects with the second embodiment.

The present disclosure is not limited to the above-mentioned embodiments and may be embodied with partly changing its configuration in an appropriate manner without departing from the scope of the disclosed technique.

Figure 20:
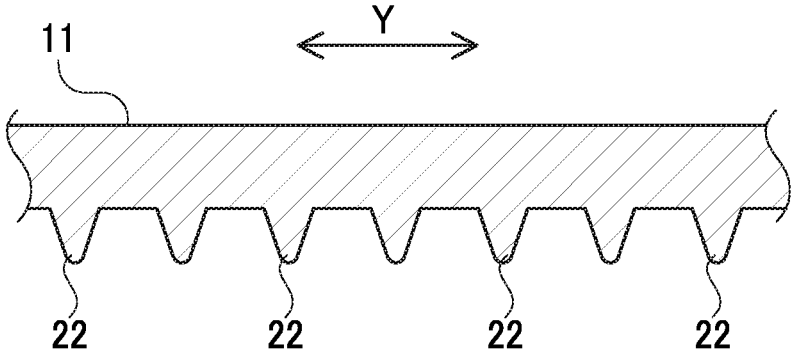
FIG. 20 is a partially enlarged sectional view of an upstream-side ridge taken along a short-side direction of a gas chamber in another embodiment.

(1) In the second, third, fourth, eighth, and ninth embodiments, the inner wall on the upstream side of the gas chamber 11 is provided with the upstream-side ridges 20A to 20F and 48A to 48J each having a fence-like shape extending in the short-side or traverse direction and protruding downward as one example of the upstream-side protruding portion. Alternatively, as shown in FIG. 20, the inner wall on the upstream side of the gas chamber 11 may be provided with a plurality of upstream-side protrusions 22 of conical shape protruding downward and being arranged in series in the short-side direction Y as another example of the upstream-side protruding portion. FIG. 20 is an enlarged sectional view of the upstream-side protrusions 22 taken along the short-side direction Y of the gas chamber 11. In this example, the condensed water is made to drop down from each of the upstream-side protrusions 22 to the corresponding downstream-side divided wall.

Figure 21:
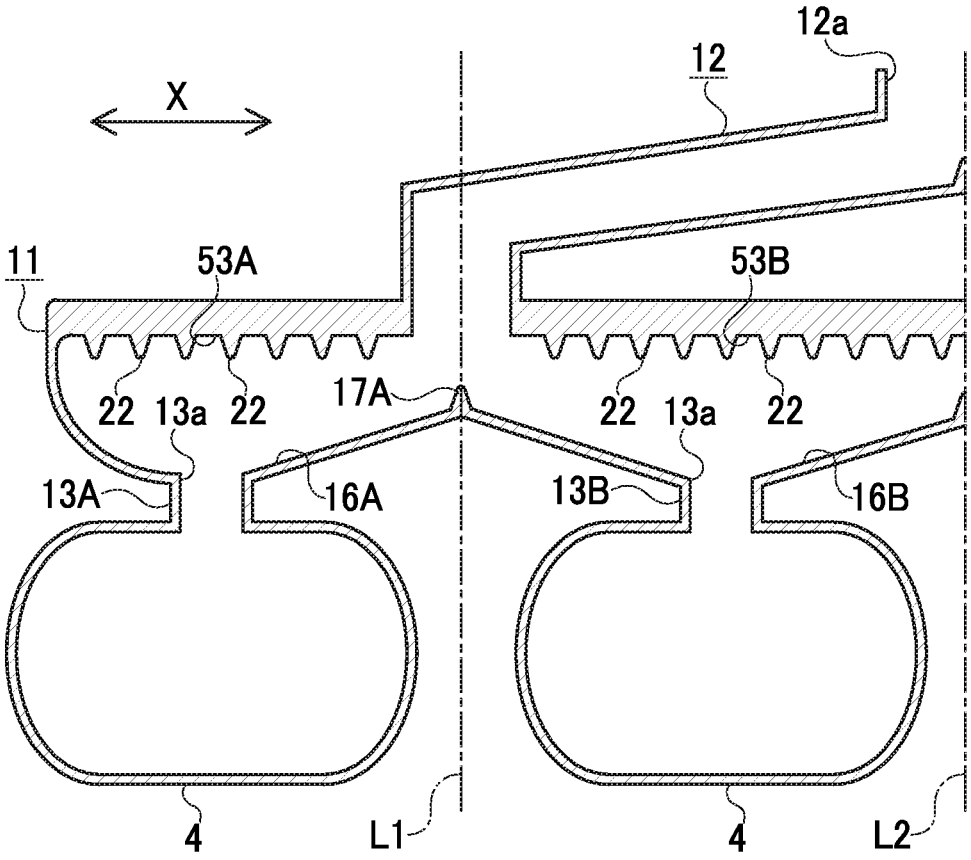
FIG. 21 a sectional view equivalent to FIG. 19, showing a part of the EGR gas distributor in another embodiment.

(2) In the ninth embodiment, the upstream-side ridges 20A to 20F of the fence-like shape extending in the short-side direction Y and protruding downward are provided in each space between the adjacent upstream-side divided walls 53A to 53D and 54A to 54C in the gas chamber 11 as one example of the upstream-side protruding portion. Alternatively, as shown in FIG. 21, a plurality of the upstream-side protrusions 22 of conical shape protruding downward may be appropriately arranged or spread over the respective upstream-side divided walls 53A to 53D of the gas chamber 11 as another example of the upstream-side protruding portions. FIG. 21 is a sectional view equivalent to FIG. 19, showing a part of an EGR gas distributor. In this example, too, the condensed water is made to drop down from each of the upstream-side protrusions 22 to the corresponding downstream-side divided walls.

(3) In the above embodiments, the EGR gas distributor 1 is made of resin material integrally with the intake manifold 2 (the branch pipes 4), but alternatively, an EGR gas distributor formed separately from the intake manifold may be post-installed in the intake manifold. In this example, configurations and flexibility in manufacturing of the intake manifold and the EGR gas distributor can be enhanced.

(4) In the above first to eights embodiments, the upstream-side divided walls 18A to 18D, 19A to 19C, 28A to 28C, 29A, 29B, and 47A to 47K are of curved shape so that the tip portions 18*a*, 19*a*, and 47*a* of protrusion-like shape protrude outward from the gas chamber 11. Alternatively, the shape of the tip portions may be of slanted shape other than the curved shape.

(5) In the above embodiments, the EGR gas distributors 1, 31, 33, 35, 37, 45, and 51 are made of resin, but alternatively, the EGR gas distributor may be made of metal such as aluminum or may be made by combination of metal and resin.

(6) In the above embodiments, each of the downstream-side divided walls 16A to 16D and 26A to 26C are configured to be slanted to the inlets 13*a* of the corresponding gas outflow passages 13A to 13D, but alternatively, each of the downstream-side divided walls may be of protrusion-like curved shape protruding toward an inlet of the corresponding gas outflow passage.

INDUSTRIAL APPLICABILITY

This disclosed technique can be applied to a gasoline engine or a diesel engine provided with an EGR apparatus.

REFERENCE SIGNS LIST

1 EGR gas distributor
2 Intake manifold
4 Branch pipe
11 Gas chamber
12 Gas inflow passage
12*a* Inlet
12*b* Outlet
13A to 13D Gas outflow passage
13*a* Inlet
16A to 16D Downstream-side divided wall
17A to 17C Downstream-side dividing ridge
18A to 18D Upstream-side divided wall (Large)
18*a* Tip portion
19A to 19C Upstream-side divided wall (Small)
19*a* Tip portion
20A to 20F Upstream-side ridge (Upstream-side protruding portion)
22 Upstream-side protrusion (Upstream-side protruding portion)
26A to 26C Downstream-side divided wall
27A, 27B Downstream-side dividing ridge
28A to 28C Upstream-side divided wall (Large)
29A, 29B Upstream-side divided wall (Small)
30A to 30D Upstream-side ridge (Upstream-side protruding portion)
31 EGR gas distributor
33 EGR gas distributor
35 EGR gas distributor
37 EGR gas distributor
40 Upstream-side ridge (Upstream-side protruding portion)
45 EGR gas distributor
47A to 47K Upstream-side divided wall
47*a* Tip portion
48A to 48J Upstream-side ridge (Upstream-side protruding portion)
51 EGR gas distributor
53A to 53D Upstream-side divided wall (Large)
54A to 54C Upstream-side divided wall (Small)

What is claimed is:

1. An EGR gas distributor configured to distribute EGR gas to each of a plurality of branch pipes of an intake manifold, the EGR gas distributor comprising:

a gas chamber in which the EGR gas is collected;

a gas inflow passage configured to introduce the EGR gas into the gas chamber on an upstream side of the gas chamber;

a plurality of gas outflow passages configured to discharge the EGR gas residing in the gas chamber to a plurality of the branch pipes on a downstream side of the gas chamber; and an inner wall on the downstream side of the gas chamber being divided into a plurality of downstream-side divided walls each of which corresponds to each of a plurality of the gas outflow passages and each of which is curved or slanted to be of protrusion-like shape protruding toward an inlet of the corresponding gas outflow passage, and a downstream-side dividing ridge as a boundary provided between the adjacent downstream-side divided walls, wherein an inner wall on the upstream side of the gas chamber is placed to face the inner wall on the downstream side and is provided with at least one upstream-side protruding portion protruding toward the downstream-side divided wall in each area corresponding to the respective downstream-side divided walls, and the inner wall on the upstream side is divided into a plurality of upstream-side divided walls by the upstream-side protruding portion, and each of the plurality of upstream-side divided walls has a tip portion of curved or slanted protrusion-like shape protruding away from the gas chamber in a transverse direction of the gas chamber.

2. The EGR gas distributor according to claim 1, wherein the upstream-side protruding portion includes an upstream-side ridge protruding toward the downstream-side divided wall and arranged in series in an arrangement direction of the downstream-side dividing ridge.

3. The EGR gas distributor according to claim 2, wherein the downstream-side dividing ridge and the upstream-side ridge are displaced not to face each other.

4. The EGR gas distributor according to claim 1, wherein surface areas of the respective downstream-side divided walls are approximated to one another.

5. The gas distributor according to claim 1, wherein the inner wall on the upstream side has a surface area in each area corresponding to the respective downstream-side divided walls, the surface area being approximated to one another.

6. The EGR gas distributor according to claim 2, wherein the upstream-side ridge is of a fence-like shape.

7. The EGR gas distributor according to claim 1, wherein the downstream-side dividing ridge is of a fence-like shape.

* * * * *